US011169481B2

(12) United States Patent
Soga

(10) Patent No.: US 11,169,481 B2
(45) Date of Patent: Nov. 9, 2021

(54) MEDIUM CUTTING DEVICE AND IMAGE FORMATION APPARATUS

(71) Applicant: Oki Data Corporation, Tokyo (JP)

(72) Inventor: Atsushi Soga, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 41 days.

(21) Appl. No.: 16/716,361

(22) Filed: Dec. 16, 2019

(65) Prior Publication Data

US 2020/0264548 A1 Aug. 20, 2020

(30) Foreign Application Priority Data

Feb. 20, 2019 (JP) ..... JP2019-028831

(51) Int. Cl.

*G03G 15/00* (2006.01)
*B65H 35/06* (2006.01)
*B65H 35/08* (2006.01)

(52) U.S. Cl.

CPC ..... *G03G 15/6523* (2013.01); *B65H 35/06* (2013.01); *B65H 35/08* (2013.01); *B65H 2301/515323* (2013.01); *G03G 2215/00814* (2013.01)

(58) Field of Classification Search

CPC ..... G03G 15/6523; G03G 2215/00814; B65H 35/06; B65H 35/08; B65H 2301/515323
See application file for complete search history.

(56) References Cited

U.S. PATENT DOCUMENTS

2011/0107885 A1* 5/2011 Nihashi ..... B26D 1/385 83/13

FOREIGN PATENT DOCUMENTS

JP 2010-76090 A 4/2010

* cited by examiner

*Primary Examiner* — Ryan D Walsh
(74) *Attorney, Agent, or Firm* — Metrolex IP Law Group, PLLC

(57) ABSTRACT

A medium cutting device according to an embodiment may include: a fixed blade provided on one side with respect to a conveyance path in which a medium is conveyed in a thickness direction of the medium orthogonal to a surface of the medium and including a cutting edge thereof; a rotary blade provided on the other side with respect to the conveyance path in the thickness direction, and including a cutting edge thereof, wherein the rotary blade is rotatable and configured to be rotated in a rotation direction so that the cutting edge of the rotary blade passes through the cutting edge of the fixed blade to cut the medium being conveyed. The rotary blade includes, on an outer circumferential surface, a recessed portion provided on a side of the cutting edge of the rotary blade in a reverse direction opposite to the rotation direction of the rotary blade.

16 Claims, 12 Drawing Sheets

MEDIUM CUTTING DEVICE AND IMAGE FORMATION APPARATUS

CROSS REFERENCE TO RELATED APPLICATIONS

This application claims priority based on 35 USC 119 from prior Japanese Patent Application No. 2019-028831 filed on Feb. 20, 2019, entitled "MEDIUM CUTTING DEVICE AND IMAGE FORMATION APPARATUS", the entire contents of which are incorporated herein by reference.

BACKGROUND

The disclosure may relate to a medium cutting device and an image formation apparatus, and, for example, may be applicable to an electrophotographic image formation apparatus such as an electrophotographic printer, copying machine, or the like.

In a related art, there is a medium cutting device that includes a fixed blade located above a conveyance path along which a long continuous sheet is conveyed and a rotary blade located below the conveyance path and configured to driven to rotate to cut the sheet by rotating a cutting edge of the rotary blade to passes through a cutting edge of the fixed blade while conveying the sheet (for example, see Patent Document 1).

Patent Document 1: Japanese Patent Application Publication No. 2010-76090

SUMMARY

In such a medium cutting device, there is a possibility of jamming of the sheet in the device.

An object of an aspect of one or more embodiments may be to provide a medium cutting device and an image formation apparatus capable of preventing a medium from traveling in an unintended direction after cutting the medium so as to stably convey the medium.

An aspect of one or more embodiments may be a medium cutting device that includes: a fixed blade provided on one side with respect to a conveyance path in which a medium is conveyed in a thickness direction of the medium orthogonal to a surface of the medium and including a cutting edge thereof; and a rotary blade provided on the other side with respect to the conveyance path in the thickness direction, and including a cutting edge thereof, wherein the rotary blade is rotatable and configured to be rotated in a rotational direction so that the cutting edge of the rotary blade passes through the cutting edge of the fixed blade to cut the medium being conveyed. The rotary blade includes, on an outer circumferential surface, a recessed portion provided on a side of the cutting edge of the rotary blade in a reverse direction opposite to the rotational direction of the rotary blade.

Another aspect of one or more embodiments may be an image formation apparatus including the above medium cutting device.

According to the above aspects, after the medium is cut at a cutting position, when a catted edge of the medium, which is, a leading end of the medium in the conveyance direction, is reached to the rotary blade, the leading end of the medium is caught by the recessed portion of the rotary blade and moved toward the fixed blade along with the rotation of the rotary blade and thus can be passed between the rotary blade and the fixed blade along the conveyance path.

Therefore, the aspects may realize a medium cutting device and an image formation apparatus that can prevent the medium from traveling in an unintended direction after cutting and thus can stably convey the medium.

DETAILED DESCRIPTION

Figure 1:
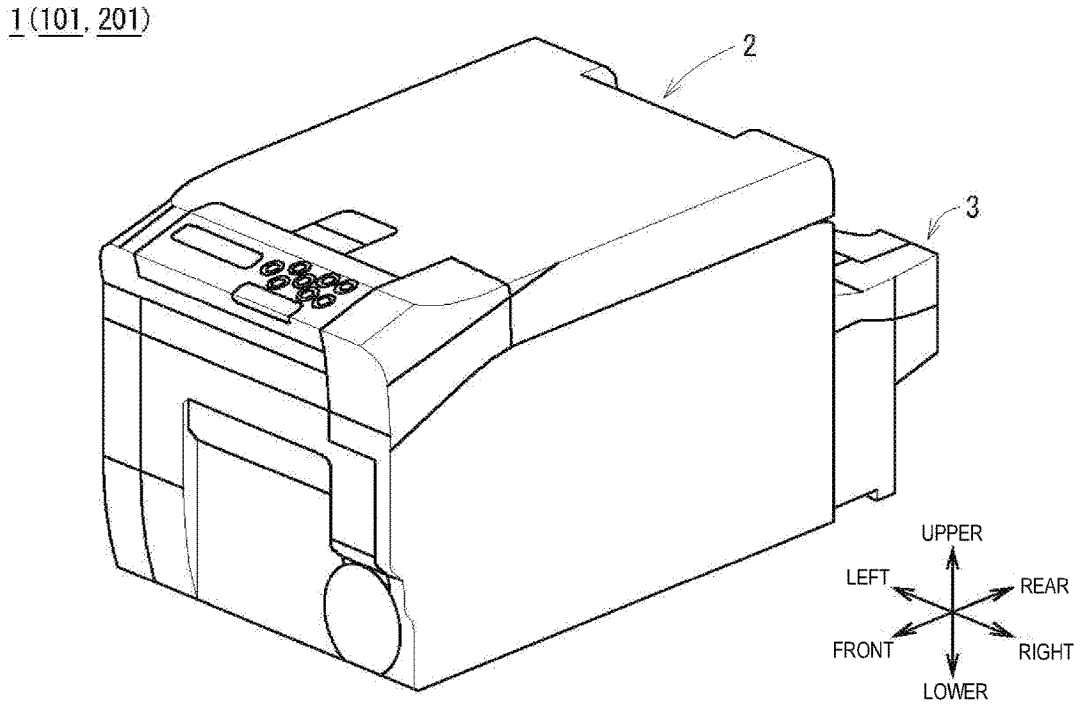
FIG. 1 is a diagram illustrating a perspective view of an external configuration of an image formation apparatus.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

1. First Embodiment

[1-1. Configuration of Image Formation Apparatus]

Figure 2:
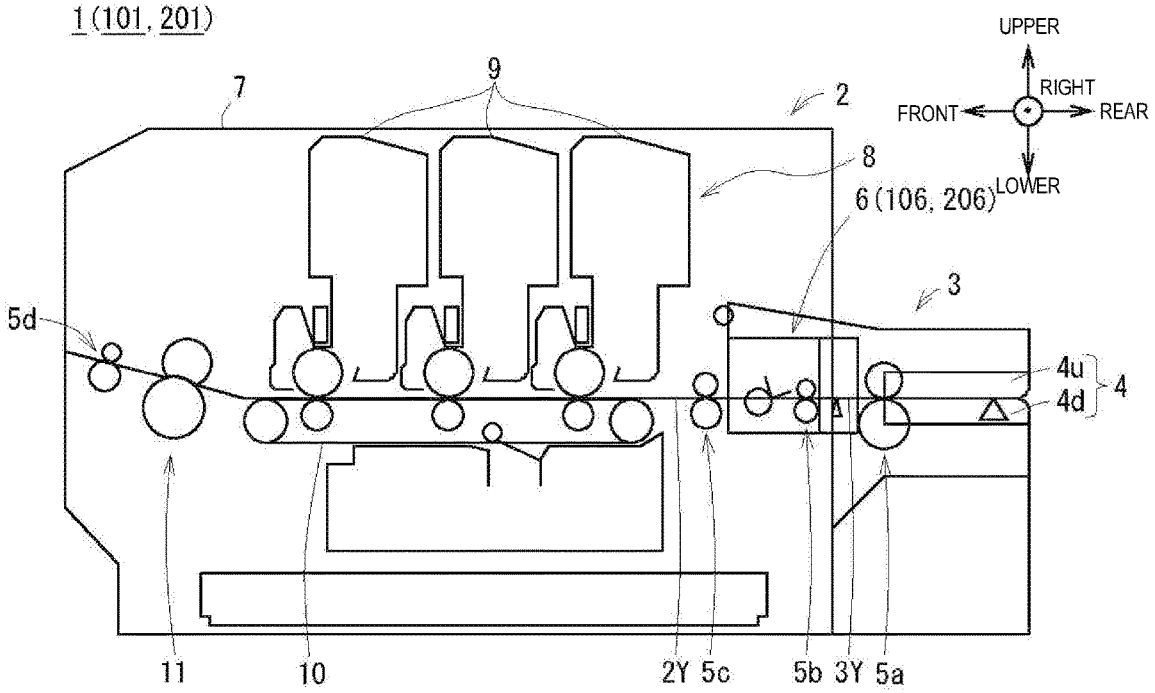
FIG. 2 is a diagram illustrating a right side view of an internal configuration of the image formation apparatus.

As illustrated in FIGS. 1 and 2, an image formation apparatus 1 is configured as an electrophotographic printer, to print a desired color image on a long continuous sheet, for example, serving as a medium. The image formation apparatus 1 includes a main body unit 2 that performs a printing processing, a conveyance cutting unit 3 that is provided on a rear side of the main body unit 2 and conveys and cuts the sheet, and a roll feeder unit (not illustrated) that is provided on the rear side of the conveyance cutting unit 3 and configured to feed the sheet. For convenience of explanation, the main body unit 2 side may be referred to as a front direction, the conveyance cutting unit 3 side may be referred to as a rear direction, a front side of the page of FIG. 2 may be referred to as a right direction, a back side of the page of FIG. 2 may be referred to as a left direction, an upper side of the apparatus may be referred to as an upper direction, and a lower side of the apparatus may be referred to as a lower direction. The long continuous sheet is wound in a roll shape by being rolled around an outer peripheral surface of a core member (not illustrated) extending along the left-right direction, and one of the longitudinal ends of the sheet is peeled off from the outermost periphery thereof and is to be conveyed to a conveyance path 3*y* and 2Y during printing.

The conveyance cutting unit 3 includes a conveyance path 3*y* therein extending in a front-rear direction. The conveyance cutting unit 3 includes a sheet guide 4, a conveyance roller pair 5*a*, and a sheet cutting unit 6, serving as a medium cutting device, which are sequentially arranged from the back side to the front side along the conveyance path 3Y in the conveyance cutting unit 3. The sheet guide 4 includes an upper sheet guide 4*u* formed with a guide surface that guides an upper surface of the sheet being conveyed on the conveyance path 3Y, and a lower sheet guide 4*d* formed with a guide surface that guides a lower surface of the sheet being conveyed on the conveyance path 3Y. Each of the conveyance roller pair 5*a* and a conveyance roller pair 5*b* includes two conveyance rollers arranged so as to sandwich the conveyance path 3Y from above and below. By rotating the conveyance rollers of the conveyance roller pairs 5*a* and 5*b*, the sheet is conveyed in the front direction as a conveyance direction. Hereinafter, the left-right direction which is orthogonal to the thickness direction of the sheet and orthogonal to the conveyance direction may be referred to as a conveyance width direction.

The sheet cutting unit 6 is a rotary cutter unit that includes a fixed blade and a rotary blade, and configured to cut the sheet while conveying the sheet. Specifically, the sheet cutting unit 6 includes therein the fixed blade and the rotary blade for cutting the sheet, and the conveyance roller pair 5*b* for conveying the sheet, and the like. The sheet cutting unit 6 cuts the sheet for each predetermined sheet length along the conveyance direction, conveys the sheet along the conveyance path 3Y by the conveyance roller pair 5*b*, to feed the sheet into the main body unit 2 provided on the front side of the sheet cutting unit 6, so as to deliver the sheet to the roller pair 5*c* in the main body unit 2.

The main body unit 2 includes therein the conveyance path 2Y extending in the front-rear direction. The conveyance roller pair 5*c* includes two conveyance rollers arranged so as to sandwich the conveyance path 2Y from above and below. The conveyance roller pair 5*c* conveys the sheet forward along the conveyance path 2Y by rotating the conveyance rollers thereof. The main body unit 2 is provided with an image formation section 8 at an upper portion in a main body housing 7 formed in a rectangular parallelepiped shape. In the image formation section 8, three process units 9 are arranged and aligned in the front-rear direction. Each process unit 9 forms a toner image of a predetermined color in response to the control of a control unit (not illustrated), and transfers the toner image onto the sheet being conveyed by a transfer belt 10. The transfer belt 10 is wound around a plurality of belt rollers. The transfer belt 10 is driven to run by one or more of the plurality of belt rollers, to convey the sheet forward along the conveyance path 2Y to feed the sheet to the fixing device 11.

The fixing device 11 includes fixing rollers disposed on the lower side and the upper side of the conveyance path 2Y, respectively. The fixing device 11 applies heat and pressure to the sheet by heating and rotating the fixing rollers, to fix the toner image on the sheet so as to print an image on the sheet. The fixing device 11 conveys the printed sheet toward a conveyance roller pair 5*d* provided on the front side of the fixing device 11. The conveyance roller pair 5*d* includes two conveyance rollers arranged so as to sandwich the conveyance path 2Y from above and below. The conveyance roller pair 5*d* conveys the printed sheet forward along the conveyance path 2Y by rotating the conveyance rollers thereof, to discharge the printed sheet through a discharge port to the outside of the main body unit 2.

[1-2. Configuration of Sheet Cutting Unit]

Figure 3:
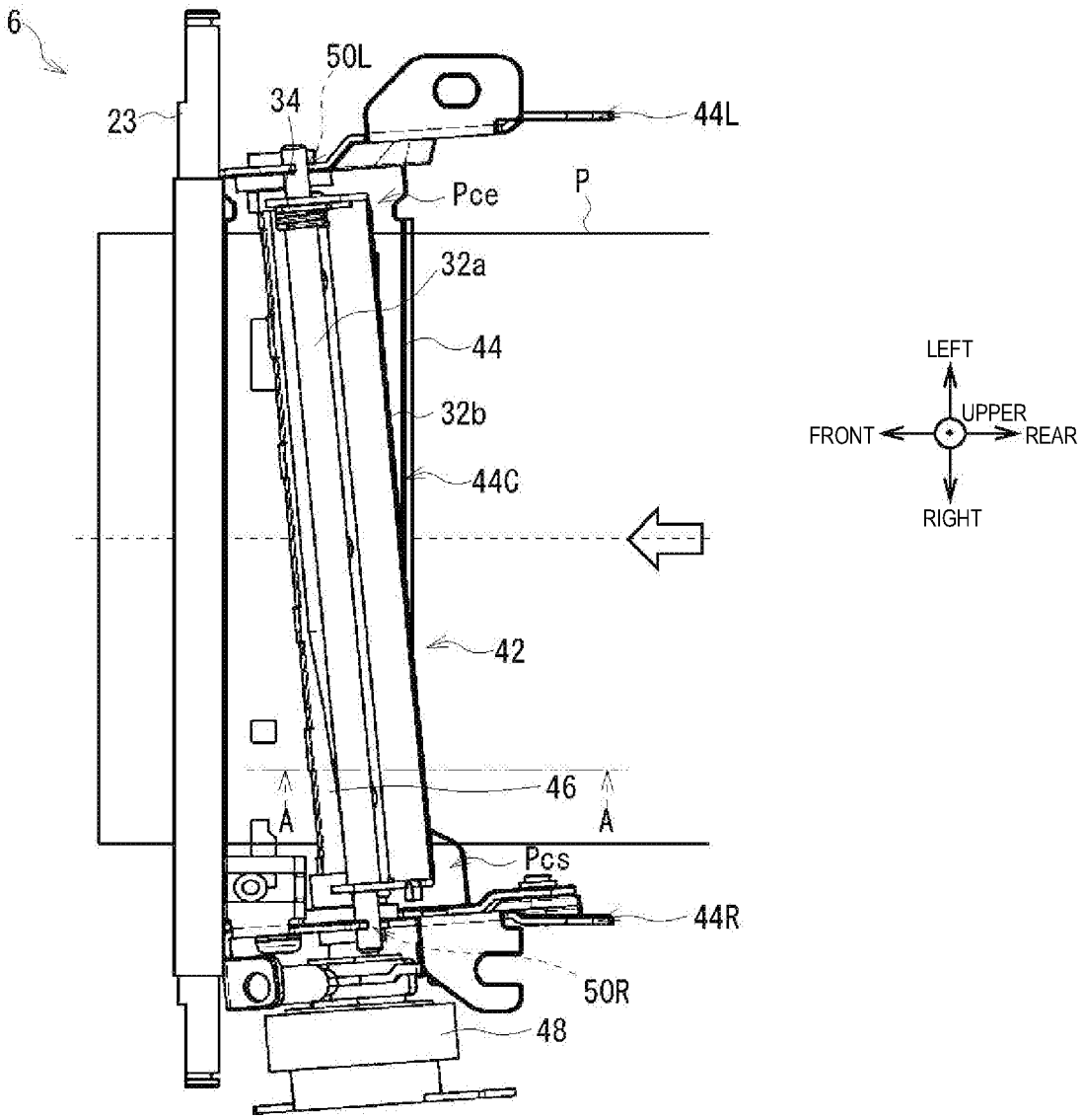
FIG. 3 is a diagram illustrating a plan view of configurations of a fixed blade unit and a rotary blade unit in a cover closed state.
Figure 4:
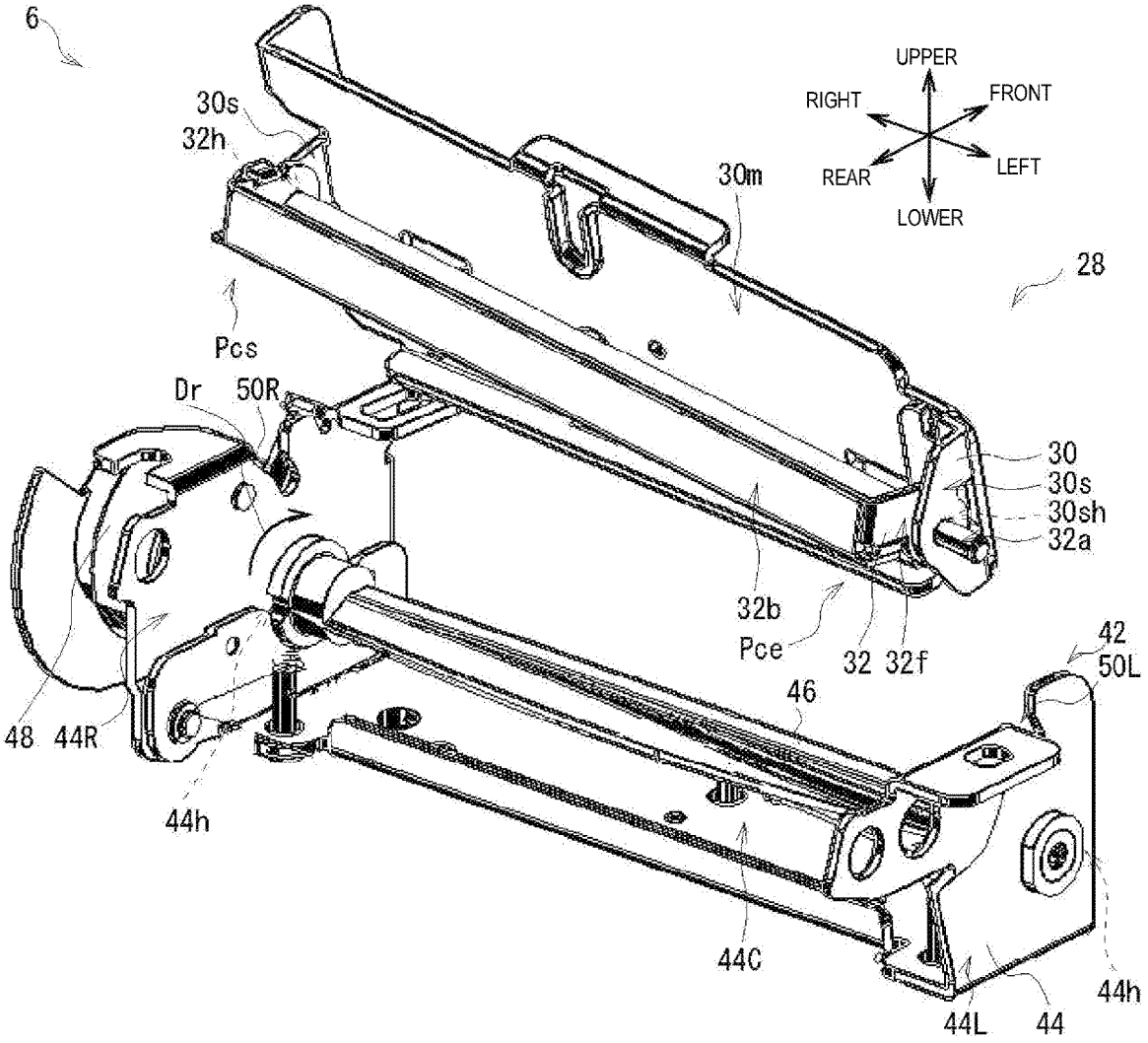
FIG. 4 is a diagram illustrating a perspective view (1) of a configuration of a fixed blade unit and a rotary blade unit in a cover opened state.
Figure 5:
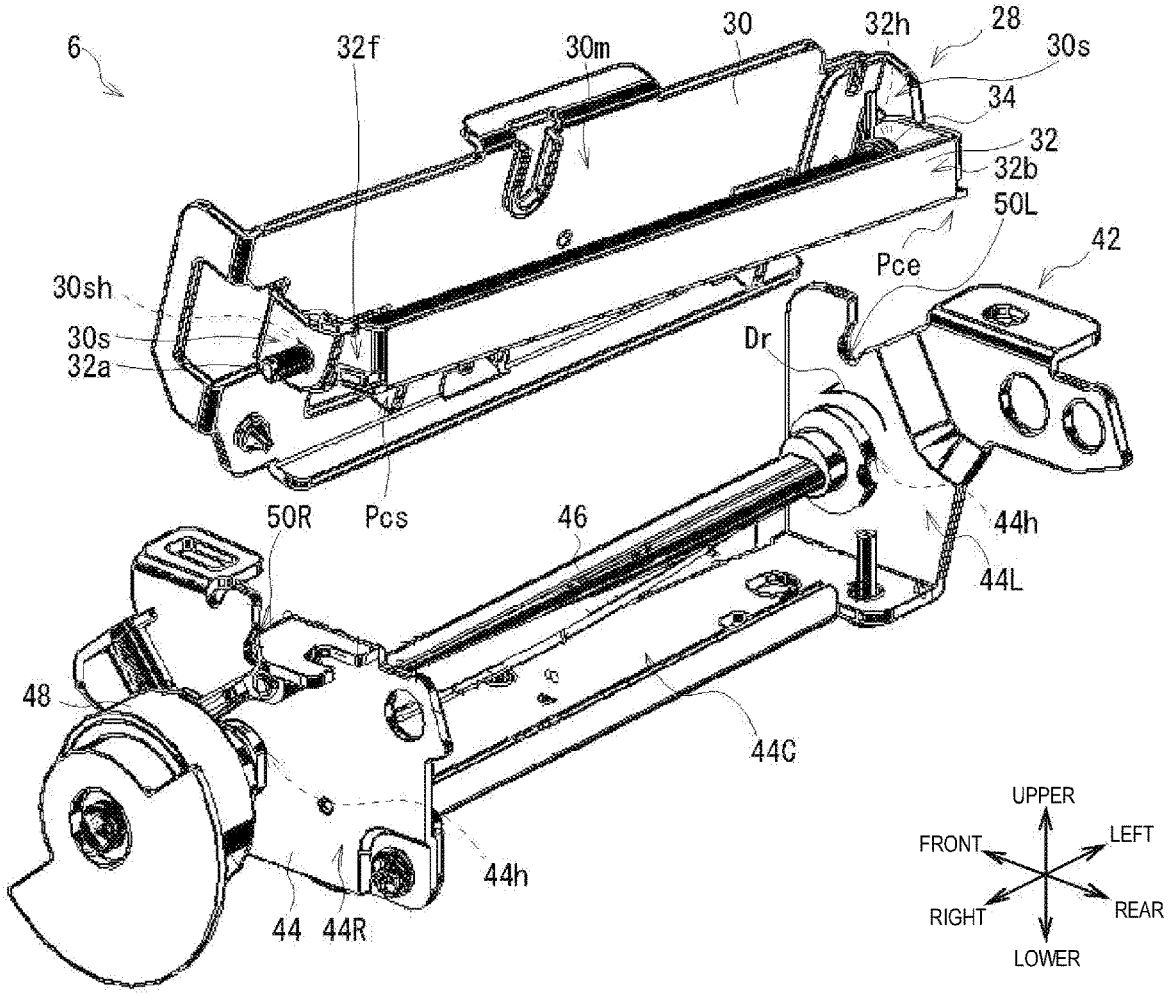
FIG. 5 is a diagram illustrating a perspective view (2) of the configuration of the fixed blade unit and the rotary blade unit in the cover opened state.

As illustrated in FIGS. 4 and 5, the sheet cutting unit 6 mainly includes a fixed blade unit 28 and a rotary blade unit 42. The fixed blade unit 28 is disposed mostly on the upper side with respect to the conveyance path 3Y (FIG. 2), and the rotary blade unit 42 is disposed mainly on the lower side with respect to the conveyance path 3Y (FIG. 2). The fixed blade unit 28 is rotatable (openable) with respect to the rotary blade unit 42 about a shaft 23 illustrated in FIG. 3 as a fulcrum, so as to transition between a cover opened state illustrated in FIGS. 4 and 5 and a cover closed state illustrated in FIG. 3.

When the sheet cutting unit 6 performs the cutting operation and the main body unit 2 performs the printing operation, the sheet cutting unit 6 is in the cover closed state in which the fixed blade unit 28 is rotated to be pushed down about the shaft 23 (FIG. 3) as the fulcrum, so as not to expose the conveyance path 3Y to the outside to protect the inside of the sheet cutting unit 6. To the contrary, when maintenance work is performed, for example, the jammed sheet is removed for the sheet cutting unit 6 by an user, the sheet cutting unit 6 is in the cover opened state in which the fixed blade unit 28 is rotated to be lifted up about the shaft 23 (FIG. 3) as the fulcrum, to expose the conveyance path 3Y to the outside, so that the maintenance work in the sheet cutting unit can be easily performed.

Figure 7:
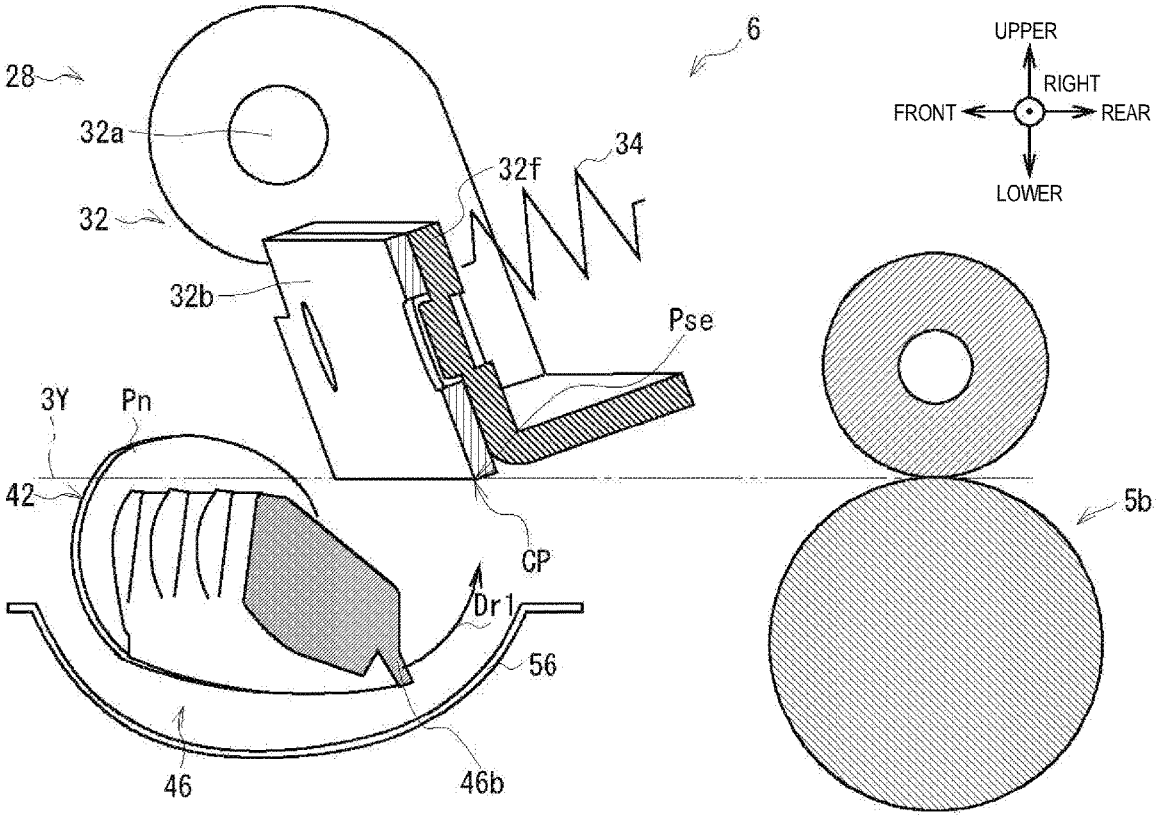
FIG. 7 is a diagram illustrating a cross-sectional view taken along the line A-A in FIG. 3, illustrating a configuration of a sheet cutting unit.
Figure 13:
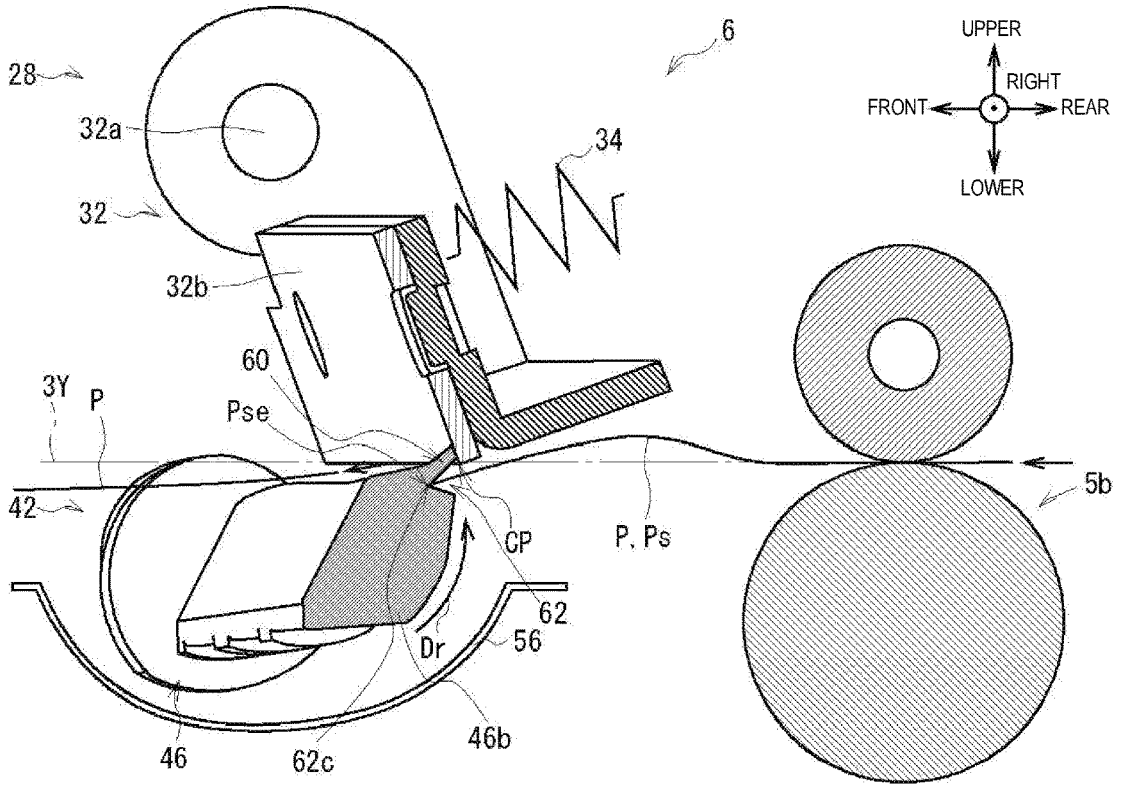
FIG. 13 is a diagram illustrating a cross-sectional view taken along the line A-A in FIG. 3, illustrating a state (2) in which the sheet is being conveyed.

In the cover closed state, the sheet cutting unit 6 drives a rotary blade 46*b* to rotate in a blade rotation direction Dr1, which is a counterclockwise direction in FIG. 7, while conveying the sheet by the conveyance roller pair 5*b* (FIG. 7). With this operation, the cutting of the sheet is started from the cutting start position Pcs (FIG. 3) on the right end of the sheet, and the cutting of the sheet is ended at the cutting end position Pce (FIG. 3) on the left end of the sheet. In this way, the sheet cutting unit 6 cuts the sheet along the conveyance width direction from the cutting start position Pcs on the right side of the sheet toward the cutting end position Pce on the left side of the sheet. Hereinafter, a portion of the sheet P that is cut at the cutting point CP and located on the upstream side from the cutting point CP in the conveyance direction may be referred to as a next sheet Ps (FIG. 13), and the downstream end of the next sheet Ps in the conveyance direction may be referred to as a next sheet leading end Pse or a leading end Pse (FIG. 13).

[1-3. Configuration of Fixed Blade Unit]

As illustrated in FIGS. 4 and 5, the fixed blade unit 28 includes a fixed blade metal plate 30 and a fixed blade part 32. The fixed blade metal plate 30 includes a fixed blade metal plate main body 30*m* and a fixed blade shaft support part 30*s*. The fixed blade metal plate main body 30*m* is a plate-shaped metal plate extending in the left-right direction. The fixed blade shaft support part 30*s* is erected from both ends in the left-right direction of the fixed blade metal plate main body 30*m*. The fixed blade shaft support part 30*s* includes a fixed blade shaft support hole 30*sh*, in which the fixed blade shaft 32*a* of the fixed blade part 32 is fitted.

The fixed blade part 32 includes a fixed blade part frame 32*f*, a fixed blade 32*b*, and a fixed blade shaft 32*a*. The fixed blade part frame 32*f* is a metal plate extending in the left-right direction and includes at each of the left and right ends thereof a fixed blade shaft hole 32*h* in which the fixed blade shaft 32*a* is inserted. The fixed blade 32*b* is made of metal, extends along the conveyance width direction, and is fixed to the fixed blade part frame 32*f*. The fixed blade 32*b* has a cutting point CP (FIG. 7), which is a lower end thereof to be in contact with the rotary blade 46*b*, on the conveyance path 3Y. As illustrated in FIG. 3, the fixed blade shaft 32*a* has a cylindrical shape extending in a tilted manner with respect to the left-right direction, such that the right end of the fixed blade shaft 32*a* is located closer to the rear side than the left end of the fixed blade shaft 32*a* (that is, the right end of the fixed blade shaft 32*a* is located closer to the upstream side than the left end of the fixed blade shaft 32*a* in the conveyance direction). The fixed blade shaft 32*a* is inserted in the fixed blade shaft hole 32*h* of the blade part frame 32*f* (FIGS. 4, 5, and 7). With this, the fixed blade shaft 32*a* is inclined with respect to the shaft 23 (FIG. 3). The fixed blade part 32 is rotatably supported by the fixed blade metal plate 30 in such a manner that the fixed blade shaft 32*a* is rotatably fitted in the fixed blade shaft support hole 30*sh* of the fixed blade metal plate 30. As described above, the fixed blade 32*b* is fixed to the fixed blade part frame 32*f* and the fixed blade part frame 32*f* supports the fixed blade shaft 32*a*, so that the fixed blade 32*b* moves together with the fixed blade shaft 32*a*. A spring 34 (FIGS. 3, 5 and 7) is wound around the fixed blade shaft 32*a*. The spring 34 biases the fixed blade 32*b* of the fixed blade part 32 toward a rotary blade 46*b* of a rotary blade part 46 with a predetermined bias force, so as to press the fixed blade 32*b* against the rotary blade 46*b*. Because the fixed blade 32*b* is swingably supported with respect to the fixed blade metal plate 30, and is biased toward the rotary blade 46*b* as described above, the load at the time of cutting the sheet is made constant, so as to extend the life of the blades 32*b* and 46*b*.

[1-4. Configuration of Rotary Blade Unit]

Figure 6:
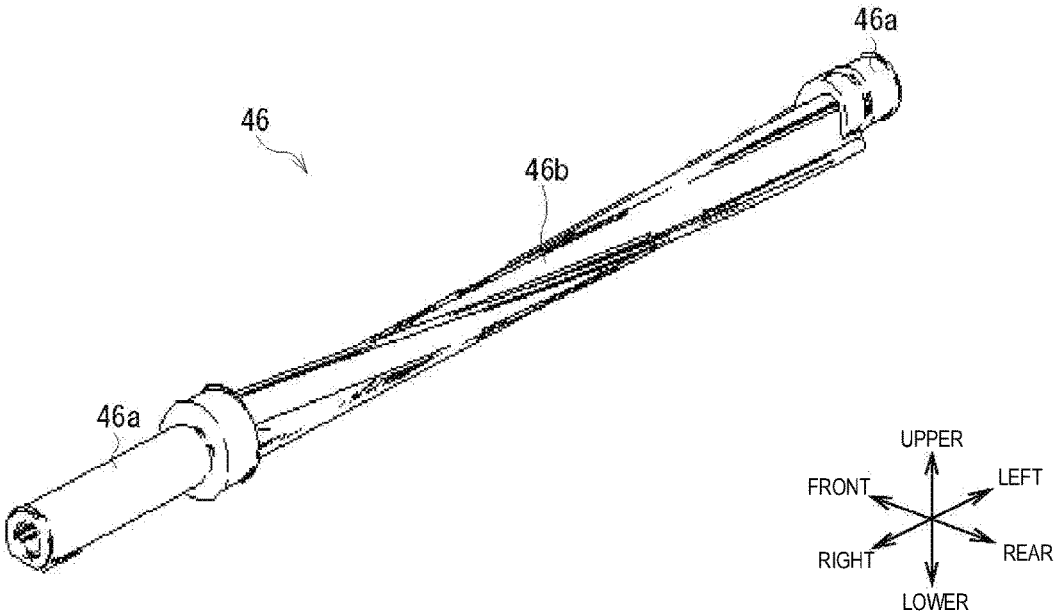
FIG. 6 is a diagram illustrating a perspective view of a configuration of a rotary blade part.

As illustrated in FIGS. 3, 4 and 5, the rotary blade unit 42 includes a rotary blade bracket 44 and the rotary blade part 46. The rotary blade bracket 44 is formed of a metal plate and has a U-shape opened upward in the front view, and includes a rotary blade shaft support portion 44R, a rotary blade shaft support portion 44L, and a left-right extension portion 44C. The rotary blade shaft support portion 44R is a plate-like member extending in a plane parallel to the front-rear direction and the vertical direction and provided on the outer side in the right direction than the fixed blade 32*b*. The rotary blade shaft support portion 44*r* includes a rotary blade shaft support hole 44*h*, in which a rotary blade shaft 46*a* of the rotary blade part 46 illustrated in FIG. 6 is rotatably fitted. The rotary blade shaft support portion 44L is a plate-like member extends in a plane parallel to the front-rear direction and the vertical direction and provided on the outer side in the left direction than the fixed blade 32*b*. The rotary blade shaft support portion 44L is opposed to the rotary blade shaft support portion 44R in the left-right direction. The rotary blade shaft support portion 44L includes a rotary blade shaft support hole 44*h*, in which the rotary blade shaft 46*a* of the rotary blade part 46 is rotatably fitted. The left-right extending portion 44C extends in the left-right direction and is connected to the rotary blade shaft support portion 44R and the rotary blade shaft support portion 44L.

The rotary blade part 46 (FIGS. 6 and 7) includes the rotary blade shaft 46*a* and the rotary blade 46*b*. The rotary blade shaft 46*a* has a substantially cylindrical shape extending along the left-right direction. The rotary blade shaft 46*a* is rotatably fitted in the rotary blade shaft support holes 44*h* of the rotary blade shaft support portion 44R and the rotary blade shaft support portion 44L, so as to be rotatable in the rotation direction Dr1 which is the counterclockwise direction in FIG. 8. The rotary blade 46*b* is provided at a portion of the rotary blade shaft 46*a* between the rotary blade shaft support portion 44R and the rotary blade shaft support portion 44L. The rotary blade 46*b* includes a cutting edge formed in a spiral shape along the conveyance width direction. The rotary blade 46*b* cuts the sheet when being rotated by the driving force transmitted through a cutter drive gear(s) 48.

The rotary blade shaft support portion 44R and the rotary blade shaft support portion 44L are respectively formed with a fitting groove 50R and a fitting groove 50L that open upward in the side view, so that the fixed blade shaft 32*a* is to be fitted in the fitting grooves 50R and 50L.

On the front side, the lower side, and the rear side of the rotary blade 46*b* (FIG. 7), a guide 56 is provided out of a rotational trajectory of the rotary blade 46*b*. The guide 56 faces upward and may guide the lower surface of the sheet being conveyed.

[1-4-1. Configuration of Rotary Blade]

Figure 8:
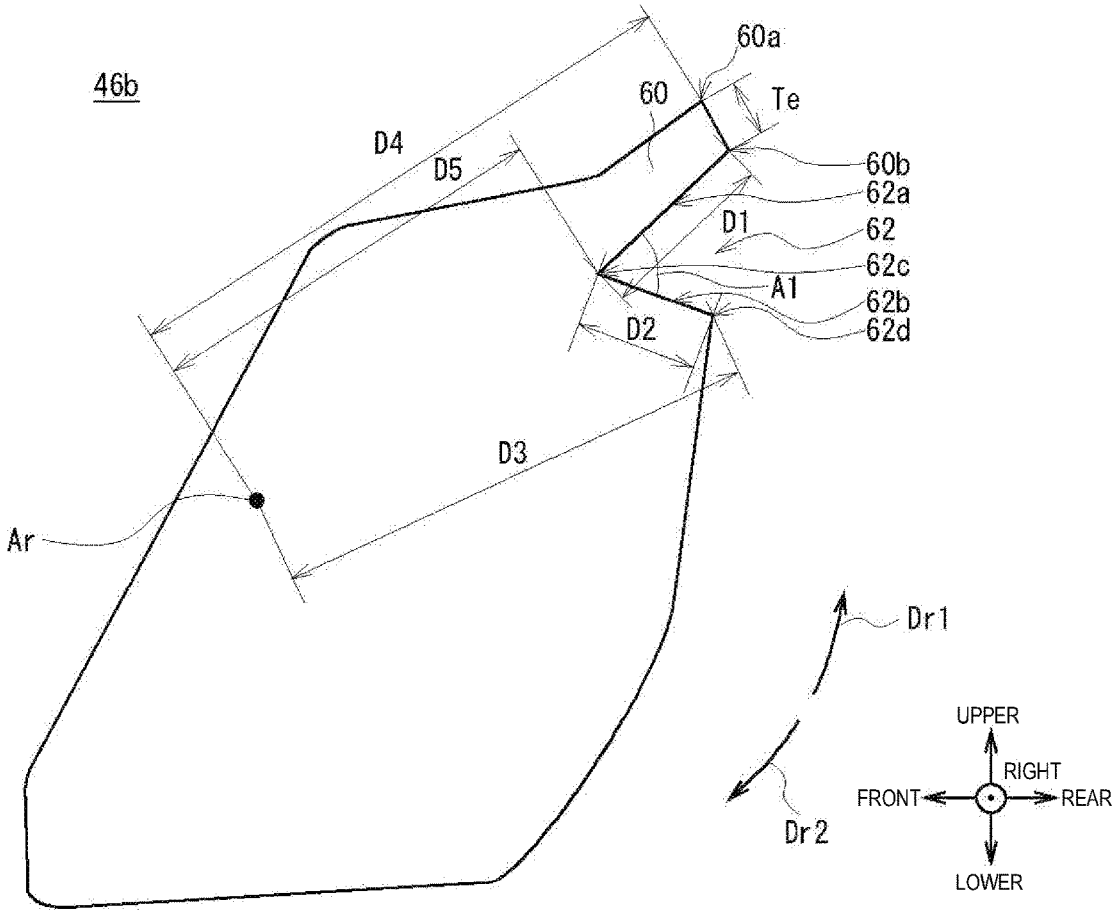
FIG. 8 is a diagram illustrating a cross-sectional view taken along the line A-A in FIG. 3, illustrating a configuration of a rotary blade according to a first embodiment.

As illustrated in FIG. 8, the rotary blade 46*b* is formed with a cutting edge 60 (blade edge 60) formed at the outermost thereof in the radial direction about the rotation axis Ar and protruding outwardly in the radial direction. The cutting edge 60 has a thickness Te along the outer circumferential direction about on the rotation axis Ar. The cutting edge 60 includes a front end 60*a* on the rotational direction Dr1 side of the cutting edge 60 and a rear end 60*b* on the reverse direction Dr2 side of the cutting edge 60. Note that in FIG. 8, hatching in the rotary blade 46*b* is omitted in order to make it easy to see the dimension lines and the like.

The rotary blade 46*b* is formed with a recessed portion 62 recessed toward the rotation axis Ar. The recessed portion 62 is provided adjacent to the cutting edge 60 on the reverse direction Dr2 side of the root of the cutting edge 60. The recessed portion 62 has a V-shape that opens outwardly in the radial direction from the rotation axis Ar in the cross-sectional view. The recessed portion 62 extends from the end of the rotary blade 46*b* on the cutting start position Pcs (FIG. 3) side to the end of the rotary blade 46*b* on the cutting end position Pce (FIG. 3) side, such that the cross sectional shape of the recessed portion 62 is continuously formed in the same shape along the conveyance width direction.

The recessed portion 62 is formed with an inner front surface 62*a*, an inner rear surface 62*b*, a bottom corner portion 62*c* at the boundary between the inner front surface and the inner rear surface, and a rear angulated portion 62*d*.

The inner front surface 62*a* of the recessed portion 62 is an inner surface on the rotational direction Dr1 side of the recessed portion 62. The cross section of the inner front surface 62*a* is linear substantially along the radial direction from the rotation axis Ar, that is, the inner front surface 62*a* has a planar shape. The inner rear surface 62*b* is an inner surface on the reverse direction Dr2 side of the recessed portion 62. The cross section of the inner rear surface 62*b* is linear substantially along a direction substantially orthogonal to the radial direction from the rotation axis Ar, that is, the inner rear surface 62*b* has a planar shape. The bottom corner portion 62*c* is located at the innermost portion of the recessed portion 62 in the radial direction about the rotation axis Ar. The bottom corner portion 62*c* is formed at the boundary between an innermost end of the inner front surface 62*a* in the radial direction about the rotation axis Ar and an innermost end of the inner rear surface 62*b* in the radial direction about on the rotation axis Ar, such that the bottom corner portion 62*c* has a canyon shape opened outwardly in the radial direction about the rotation axis Ar. The rear angulated portion 62*d* is located at the outermost end of the inner rear surface 62*b* in the radial direction about on the rotation axis Ar and located at the rearmost end of the inner rear surface 62*b* in the reverse direction Dr2. That is, the rear angulated portion 62*d* is formed of the angulated boundary between the outermost end of the inner rear surface 62*b* in the radial direction and a portion of the outer periphery of the rotary blade 46*b* on the reverse direction Dr2 side than the inner rear surface 62*b*.

[1-5. Dimensions and Angles of Rotary Blade]

[1-5-1. Distance D1]

Figure 9:
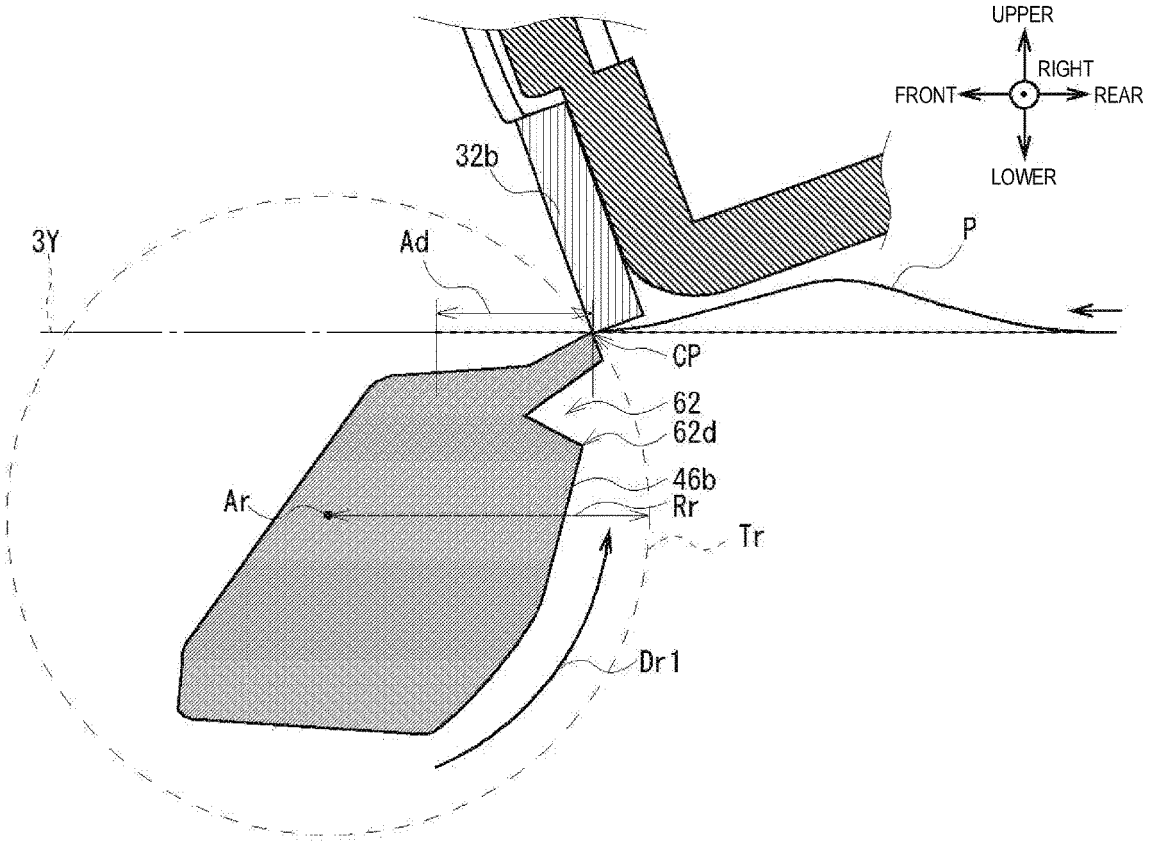
FIG. 9 is a diagram illustrating an enlarged view of a cross-section taken along the line AA in FIG. 3, for explaining an amount of deflection of the sheet and a rotational trajectory of a cutting edge of the rotary blade.

A distance D1, which is a distance from the apex of the bottom corner portion 62*c* to the rear end 60*b* of the cutting edge 60, is shorter than a sheet deflection amount Ad illustrated in FIG. 9. The sheet deflection amount Ad is a distance by which the sheet P should have traveled downstream in the conveyance direction from the cut point CP, if the sheet P that is sandwiched and blocked between the cutting edge 60 of the rotary blade 46*b* and the cutting edge of the fixed blade 32*b* by the cutting edge thickness Te (FIG. 8) during the sheet cutting process is not blocked, as indicated by a broken line in FIG. 9. The sheet deflection amount Ad is calculated by multiplying a conveyance speed St of the sheet P by a blade contact time Tb, which is a length of time during which the fixed blade 32*b* and the rotary blade 46*b* are in contact with each other when cutting the sheet. That is, the sheet deflection amount Ad is obtained by the following equation: $Ar=St\times Tb$. The blade contact time Tb is calculated by dividing the cutting edge thickness Te by a value obtained by multiplying a distance D4, which is a distance from the rotation axis Ar to the front end 60*a* of the cutting edge 60, by the rotation speed Rs of the rotary blade 46*b*. That is, the blade contact time Tb is obtained by the following equation: $Tb=Te/(D4\times Rs)$. As a result, the sheet cutting unit 6 can make the next sheet leading end Pse of the next sheet Ps (FIG. 13), which has been cut and released from bending, reach the bottom corner portion 62*c* (FIG. 8) of the recessed portion 62, and thus the leading end Pse of the next sheet Ps can be caught in the recessed portion 62.

Here, the shorter the distance D1 is, the easier it is for the leading end Pse of the next sheet Ps to enter the recessed portion 62. However, if the distance D1 is too short, it is possible that the leading end Pse of the next sheet Ps that has entered in the recessed portion 62 will easily come out of the recessed portion 62.

In light of this, in an embodiment, the distance D1 is slightly smaller than the sheet deflection amount Ad, to make the leading end Pse of the next sheet Ps to be caught in the recessed portion 62 and to prevent the leading end Pse of the next sheet Ps that has entered in the recessed portion 62 from coming out of the recessed portion 62 as well.

[1-5-2. Distance D3]

As illustrated in FIG. 8, a distance D3 between the rotation axis Ar and the rear angulated portion 62*d* is shorter than a rotational trajectory radius Rr, which is, the radius of a circular trajectory Tr of the cutting edge 60 drawn when the cutting edge 60 rotates as illustrated in FIG. 9 ($D3<Rr$). That is, the distance D3 is shorter than the distance D4 ($D3<D4$). Thus, a distance D2, which is a distance between the bottom corner portion 62*c* and the rear angulated portion 62*d*, is set to satisfy $D3<D4$. Therefore, the rear angulated portion 62*d* does not protrude to the outer side of the rotational trajectory Tr of the cutting edge 60 of the rotary blade and is located inside of the rotational trajectory Tr. As a result, the sheet cutting unit 6 prevents the rear angulated portion 62*d* from coming into contact with the fixed blade 32*b*, so that a part of the rotary blade 46*b* other than the cutting edge 60 does not contact the fixed blade 32*b*.

Here, the longer the distance D2, the easier it is for the leading end Pse of the next sheet Ps to enter the recessed portion 62. However, if the rear angulated portion 62*d* of the cutting edge is protruded outside the rotational trajectory Tr, the rear angulated portion 62*d* comes in contact with the fixed blade 32*b*, which may unintentionally cut the sheet P.

In view of this, in the sheet cutting unit 6 according to an embodiment, the distance D2 is set in such a manner that the distance D3 is slightly smaller than the radius Rr of the rotational trajectory Tr of the cutting edge of the rotary blade. Accordingly, the rear angulated portion 62*d* is not protruded to the outside of the rotational trajectory Tr of the cutting edge of the rotary blade. Thus, it is possible to prevent the rear angulated portion 62*d* from coming into contact with the fixed blade 32*b*, in addition to make the recessed portion 62 easier to catch the next sheet leading Pse of the next sheet Ps, with the distance D2 increased as much as possible.

[1-5-3. Corner Angle A1]

Figure 10:
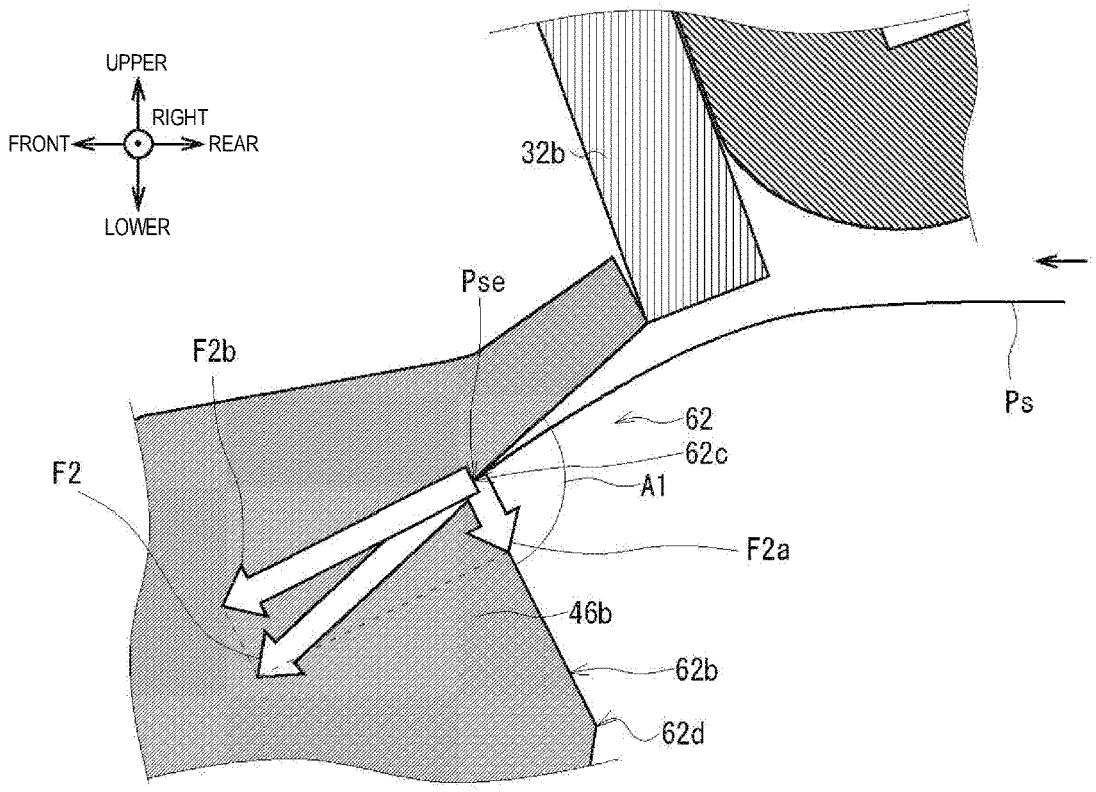
FIG. 10 is a diagram illustrating an enlarged view of the cross-section taken along the line AA in FIG. 3, for explaining a force applied from a next sheet in a case where a bottom corner angle of a recessed portion exceeds 90 degree.

In a comparison example illustrated in FIG. 10 where a bottom corner angle A1, which is an inner angle of the bottom corner portion 62*c*, is greater than 90 degree, when the next sheet leading Pse of the next sheet Ps comes in contact with the bottom corner portion 62*c* of the recessed portion 62, a force F2 is applied from the next sheet Ps to the bottom corner portion 62*c*. The force F2 can be decomposed into a component force F2*a* and a component force F2*b*. The component force F2*a* is a force parallel to the inner rear surface 62*b* in a direction from the bottom corner portion 62*c* toward the rear angulated portion 62*d*, which is directed to the outside of the recess portion 62. The component force F2*b* is a force orthogonal to the component force F2*a*, that is orthogonal to the inner rear surface 62*b*. Since there is the component force F2*a* oriented in the direction away from the bottom corner portion 62*c* toward the rear angulated portion 62*d*, the leading end Pse of the next sheet Ps moves toward the rear angulated portion 62*d* by the component force F2*a*, and thus may easily come out of the recessed portion 62.

Figure 11:
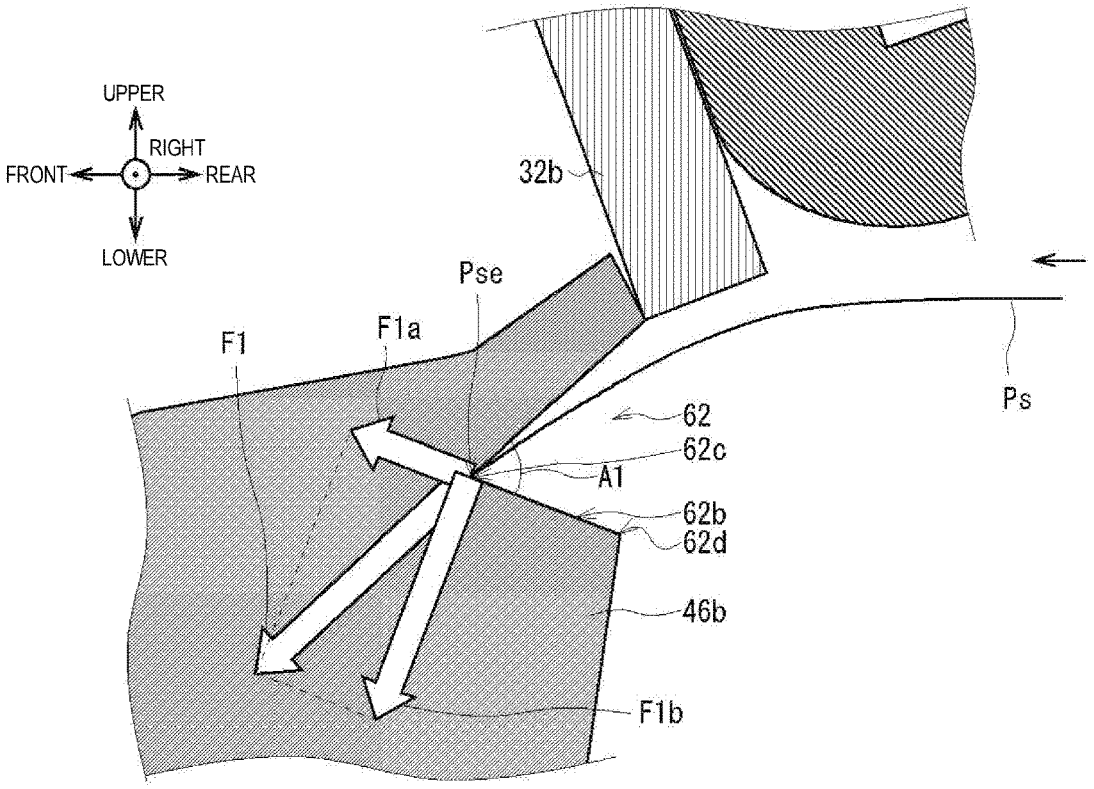
FIG. 11 is a diagram illustrating an enlarged view of the cross-section taken along the line AA in FIG. 3 for explaining the force applied from the next sheet in a case where a bottom corner angle of a recessed portion is 90 degree or less.

On the other hand, in an embodiment as illustrated in FIGS. 8 and 11, the angle A1 of the bottom corner portion 62*c* is not more than 90 degree. In other words, the angulated portion 62*d* is provided outside, in the radial direction, of a rotational trajectory of the bottom corner portion 62*b* about the rotation axis Ar. That is, the inner rear surface 62*d* is provided outside, in the radial direction, of the rotational trajectory of the bottom corner portion 62*b* about the rotation axis Ar, or the inner rear surface 62*d* extends outwardly, in the radial direction, with respect to the rotational trajectory of the bottom corner portion 62*b* about the rotation axis Ar. In an embodiment, the angle A1 of the bottom corner portion is, for example, is 60 degree. With this configuration, when the next sheet leading Pse of the next sheet Ps comes in contact with the bottom corner portion 62*c* of the recessed portion 62, a force F1 is applied from the next sheet Ps to the bottom corner portion 62*c*. The force F1 can be decomposed into a component force F1*a* and a component force F1*b*. The component force F1*a* is a force parallel to the inner rear surface 62*b* in a direction away from the rear angulated portion 62*d* toward the bottom corner portion 62*c*. The component force F1*b* is a force orthogonal to the component force F1*a*, that is, orthogonal to the inner rear surface 62*b*. Since there is the component force F1*a* which is oriented in the direction away from the rear angulated portion 62*d* toward the bottom corner portion 62*c*, the leading end Pse of the next sheet Ps is bitten into the bottom corner portion 62*c* by the component force F1*a*, and thus does not easily come out of the recessed portion 62.

Here, the smaller the bottom corner angle A1, the less likely it is that the leading end Pse of the next sheet Ps that has entered in the recessed portion 62 comes out of the interior of the recessed portion 62. However, in this case, a width of an opening of the recessed portion 62 in the circumferential direction about the rotation axis Ar will be narrower, and thus it may become difficult for the leading end Pse of the next sheet Ps to enter in the recessed portion 62.

In view of this, the sheet cutting unit 6 in an embodiment sets the bottom corner angle A1 within a range of not more than 90 degree and not less than 60 degree, for example, sets the angle A1 to 60 degree. This prevents the leading end Pse of the next sheet Ps from not entering in the recessed portion 62, while making the leading end Pse of the next sheet Ps easily caught by the recessed portion 62 and preventing the leading end Pse of the next sheet Ps that has entered the recessed portion 62 from coming out of the recessed portion 62.

[1-5-4. Distances D3, D4, D5 from Rotation Axis]

The distance D4, which is the distance from the rotation axis Ar to the front end 60*a* of the cutting edge 60, is longer than a distance D5 from the rotation axis Ar to the bottom corner portion 62*c*. Further, the distance D3, which is the distance between the rotation axis Ar and the rear angulated portion 62*d*, is longer than the distance D5. Accordingly, the relationship between the distance D4, the distance D3, and the distance D5 satisfies the following equation: D4>D3>D5.

[1-6. Sheet Cutting Operation]

Figure 12:
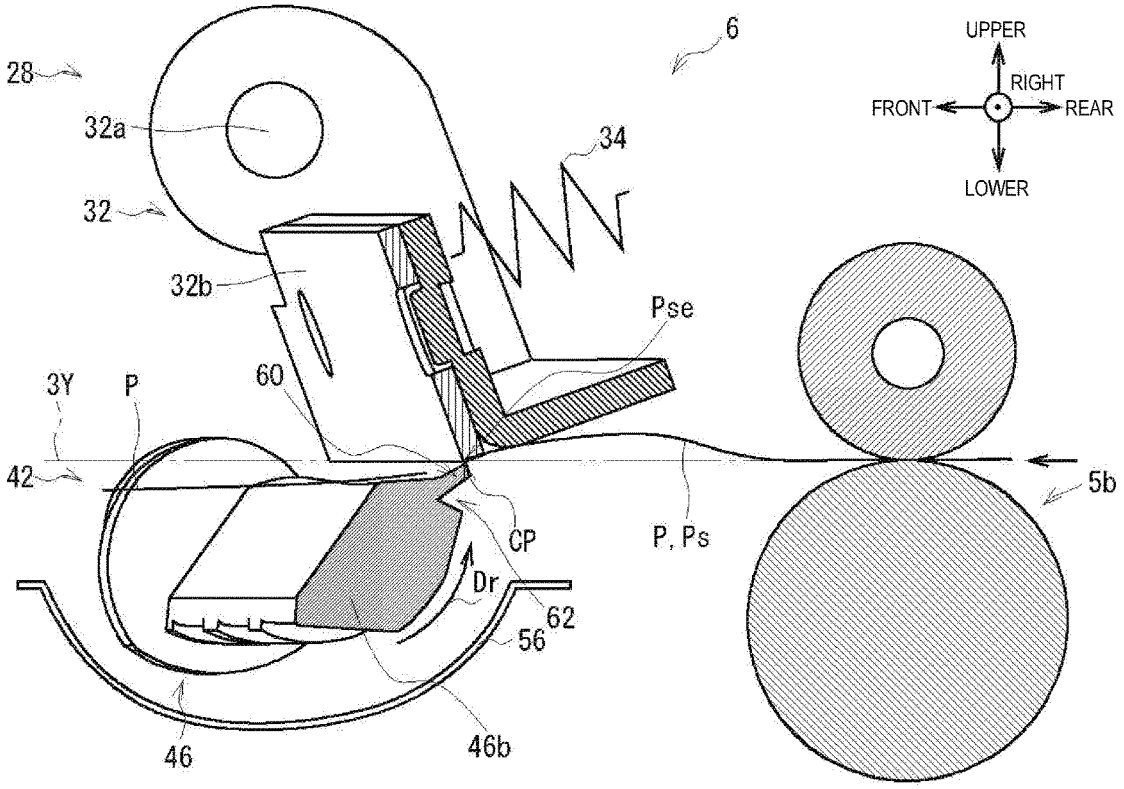
FIG. 12 is a diagram illustrating a cross-sectional view taken along the line A-A in FIG. 3, illustrating a state (1) in which a sheet is being conveyed.

In such a configuration, in the cutting operation, the sheet cutting unit 6 conveys the sheet by the conveyance roller pair 5*b* and rotates the rotary blade 46*b* in the rotation direction Dr1 as illustrated in FIG. 12, to pass the cutting edge of the rotary blade 46*b* through the cutting edge of the fixed blade 32*b* at the cutting point CP, so as to cut the sheet P. In the cutting operation, the sheet cutting unit 6 sandwiches the leading end Pse of the next sheet Ps between the cutting edge of the rotary blade 46*b* and the cutting edge of the fixed blade 32*b*, to temporarily block the movement of the next sheet Ps by the thickness Te of the cutting edge of the rotary blade 46*b* (FIG. 8)

When the cutting of the sheet P is completed, the cutting edge 60 of the rotary blade 46*b* is separated away from the cutting edge of the fixed blade 32*b*, and thus the leading end Pse of the next sheet Ps is released. In a case where the next sheet Ps is bent to the fixed blade 32*b* side (upward) during the cutting of the sheet P as illustrated in FIG. 9, the next sheet Ps tries to return to a normal shape which is not bent when the upward bending of the next sheet Ps is released, and thus the leading end Pse of the next sheet moves toward the rotary blade 46*b*, which is the lower side with respect to the conveyance path 3Y, in the direction of entering below the lower side of the rotary blade 46*b*.

Figure 14:
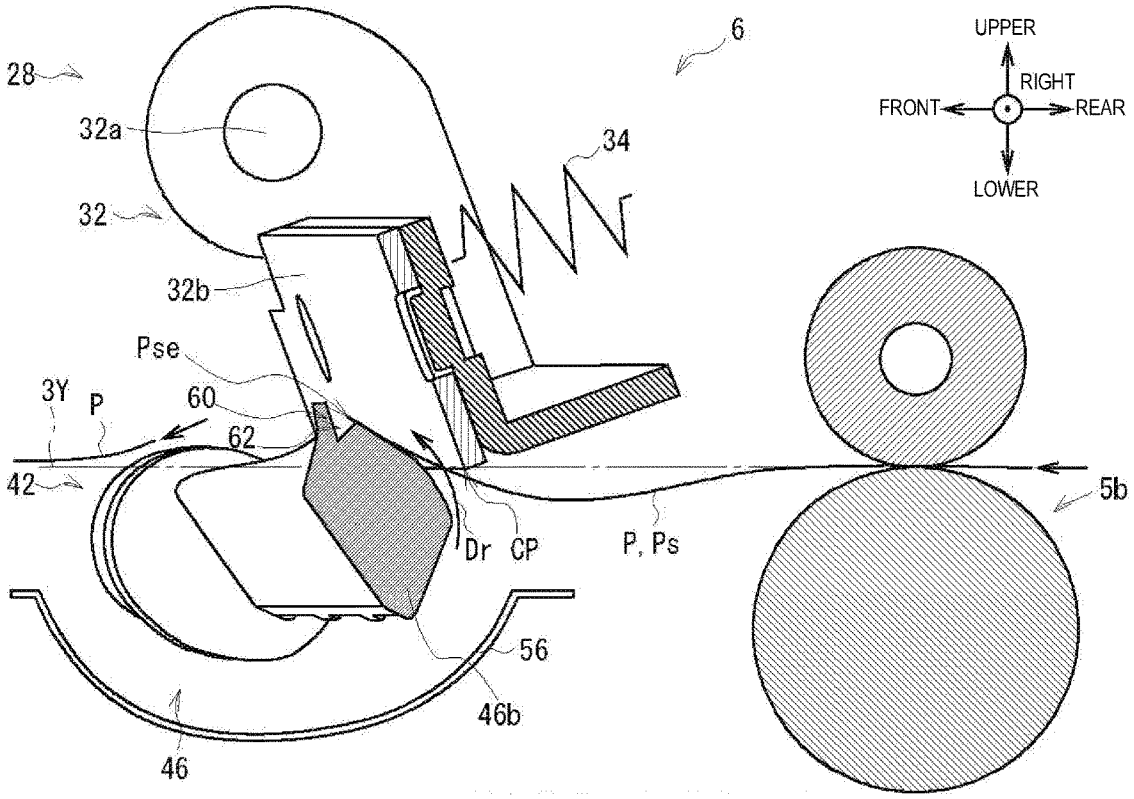
FIG. 14 is a diagram illustrating a cross-sectional view taken along line A-A in FIG. 3, illustrating a state (3) in which the sheet is being conveyed.

At this moment, as illustrated in FIG. 13, the leading end Pse of the next sheet Ps enters the recessed portion 62 of the rotary blade 46*b* and comes into contact with the bottom corner portion 62*c*, and thus the movement of the next sheet leading end Pse is regulated. As the rotary blade 46*b* continues to rotate in the rotation direction Dr1, the next sheet leading end Pse has entered in the recessed portion 62 of the rotary blade 46*b* is moved upward along with the rotation of the recessed portion 62 of the rotary blade 46*b* as illustrated in FIG. 14. As a result, the sheet cutting unit 6 can prevent the leading end Pse of the next sheet Ps from entering below the lower side of the rotary blade 46*b*.

As described above, the rotary blade 46*b* includes the recessed portion 62 having the V-shaped cross section provided on the reverse direction Dr2 side with respect to the cutting edge 60 of the rotary blade 46*b*. As a result, the recessed portion 62 of the sheet cutting unit 6 catches the leading end Pse of the next sheet Ps that tends to go downward and lifts up the next sheet leading end Pse to direct the moving direction of the next sheet leading end Pse toward the fixed blade 32*b* side which is upper than the conveyance path 3Y, to prevent the next sheet leading end Pse from moving toward the lower side of the rotary blade 46*b*.

[1-7. Advantages]

In the above configuration, the sheet cutting unit 6 according to an embodiment is configured to form the recessed portion 62 having the V-shaped cross section on the reverse direction Dr2 side of the cutting edge 60 in the rotary blade 46*b*. With this, after cutting the sheet P, the sheet cutting unit 6 catches the leading end Pse of the next sheet Ps that tends to go downward by means of the recessed portion 62 of the rotary blade 46*b* and lifts it up, to lead the next sheet leading end Pse toward the fixed blade 32*b* side. As a result, when cutting the sheet P, the sheet cutting unit 6 prevents the leading end Pse of the next sheet Ps from moving toward the lower side of the rotary blade 46*b*, to prevent the jamming therein.

Further, the sheet cutting unit 6 according to an embodiment is configured to form the recessed portion 62 at the position adjacent to the cutting edge 60 on the reverse direction Dr2 side. With this, the sheet cutting unit 6 can more reliably catch by the recessed portion 62 the next sheet leading end Pse that tends to start to sag immediately after the cutting, than a case where the recessed portion 62 is formed at the position away from the cutting edge 60 in the reverse direction Dr2.

Further, the sheet cutting unit 6 according to an embodiment is formed, on the rotary blade 46*b*, with the recessed portion 62 instead of a convex or projected portion. This configuration prevents the convex portion from interfering with the movement path of the leading end Pse of the next sheet Ps that normally goes upward, so as to prevent the sheet P from hardly being conveyed.

Further, the sheet cutting unit 6 according to an embodiment has the distance D1, which is the distance from the apex of the bottom corner portion 62*c* to the rear end 60*b* of the cutting edge 60, set smaller than the sheet deflection amount Ad. As a result, the sheet cutting unit 6 can make the leading end Pse of the next sheet Ps that is released from bending after the cutting reach the bottom corner portion 62*c* of the recessed portion 62, and thus can catch the leading end Pse of the next sheet Ps in the recessed portion 62.

Further, the sheet cutting unit 6 according to an embodiment has the distance D2, which is the distance between the bottom corner portion 62*c* and the rear angulated portion 62*d*, is set to satisfy that the distance D3, which is the distance between the rotation axis Ar and the rear angulated portion 62*d*, is smaller than the radius Rr of the rotational trajectory of the cutting edge of the rotary blade. With this configuration, the rear angulated portion 62*d* is not protruded outside of the rotational trajectory Tr of the cutting edge of the rotary blade. Therefore, the sheet cutting unit 6 can prevent the rear angulated portion 62*d* from coming in contact with the fixed blade 32*b*.

Further, in the sheet cutting unit 6 according to an embodiment, the bottom corner angle A1 is set to 90 degree or less. Thus, the sheet cutting unit 6 can prevent the next sheet leading end Pse that has entered in the recessed portion 62 from easily coming out of the recessed portion 62.

In a case where the recessed portion 62 includes plural recessed portions provided discretely along the conveyance width direction, the leading end Pse of the next sheet Ps may get stuck by the discrete recessed portions 62, to hinder the movement of the leading end Pse of the next sheet Ps toward the fixed blade 32*b* side in the normal manner. However, the sheet cutting unit 6 according to an embodiment is provided with the recessed portion 62 continuously extends along the conveyance width direction. Accordingly, the sheet cutting unit 6 can prevent the leading end Pse of the next sheet Ps from getting stuck in the recessed portion 62, so as not to hinder the movement of the leading end Pse of the next sheet Ps toward the fixed blade 32*b* side.

As described above, the sheet cutting unit 6 includes the fixed blade unit 28 provided on one side (for example, the upper side) with respect to the sheet conveyance path 3Y, serving as the medium conveyance path, in the thickness direction of the sheet P which is orthogonal to the sheet surface, and the rotary blade unit 42 provided on the other side (for example, the lower side) with respect to the sheet conveyance path 3*y*, the conveyance roller pair 5*b* for conveying the sheet, and the like. The sheet cutting unit 6 cuts the sheet for each predetermined sheet length along the conveyance direction, conveys the sheet along the conveyance path 3Y by the conveyance roller pair 5*b*, to convey the sheet toward the main body unit 2 on the front side of the sheet cutting unit 6, to deliver the sheet to the roller pair 5*c* in the main body unit 2.

With the above described configurations, when the leading end Pse of the next sheet Ps is moved toward the rotary blade 46*b* as the next sheet Ps is being conveyed, the sheet cutting unit 6 can catch the leading end Pse of the next sheet Ps by the recessed portion 62 and guide the next sheet leading end Pse toward the fixed blade 32*b* side.

Figure 17:
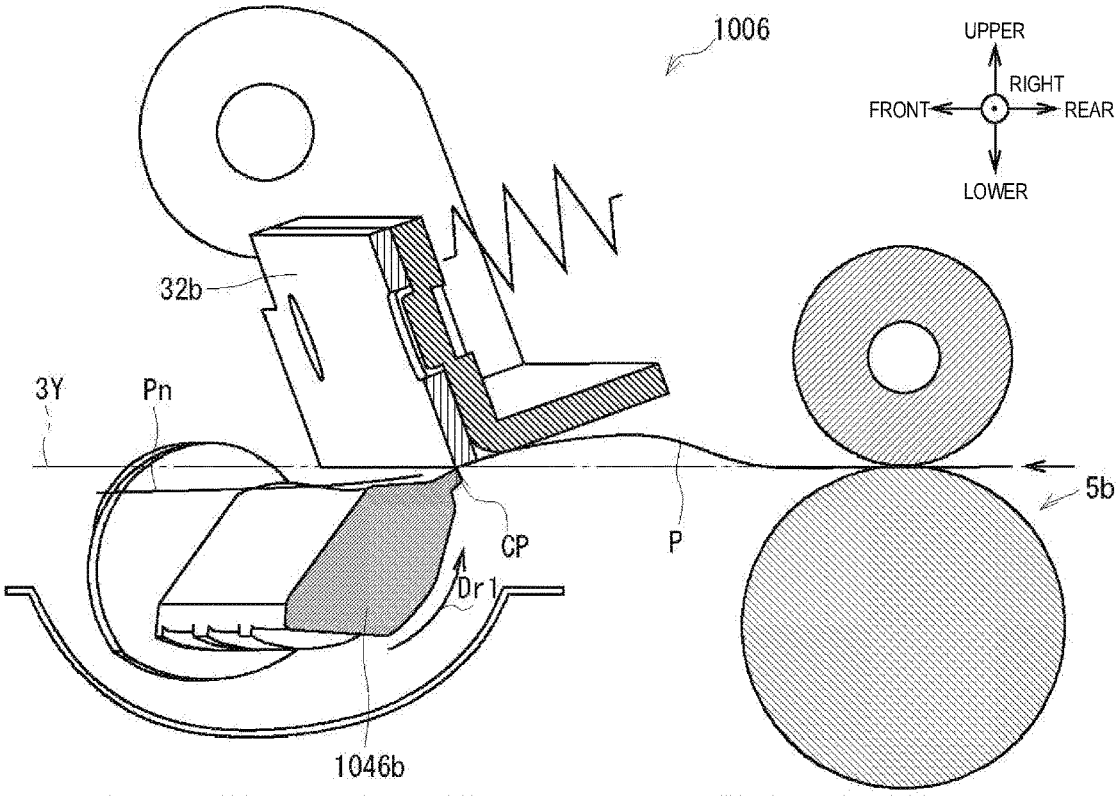
FIG. 17 is a diagram illustrating an enlarged cross-sectional view of a sheet cutting unit according to a related art, in a state (1) where a sheet is being conveyed in the sheet cutting unit.
Figure 18:
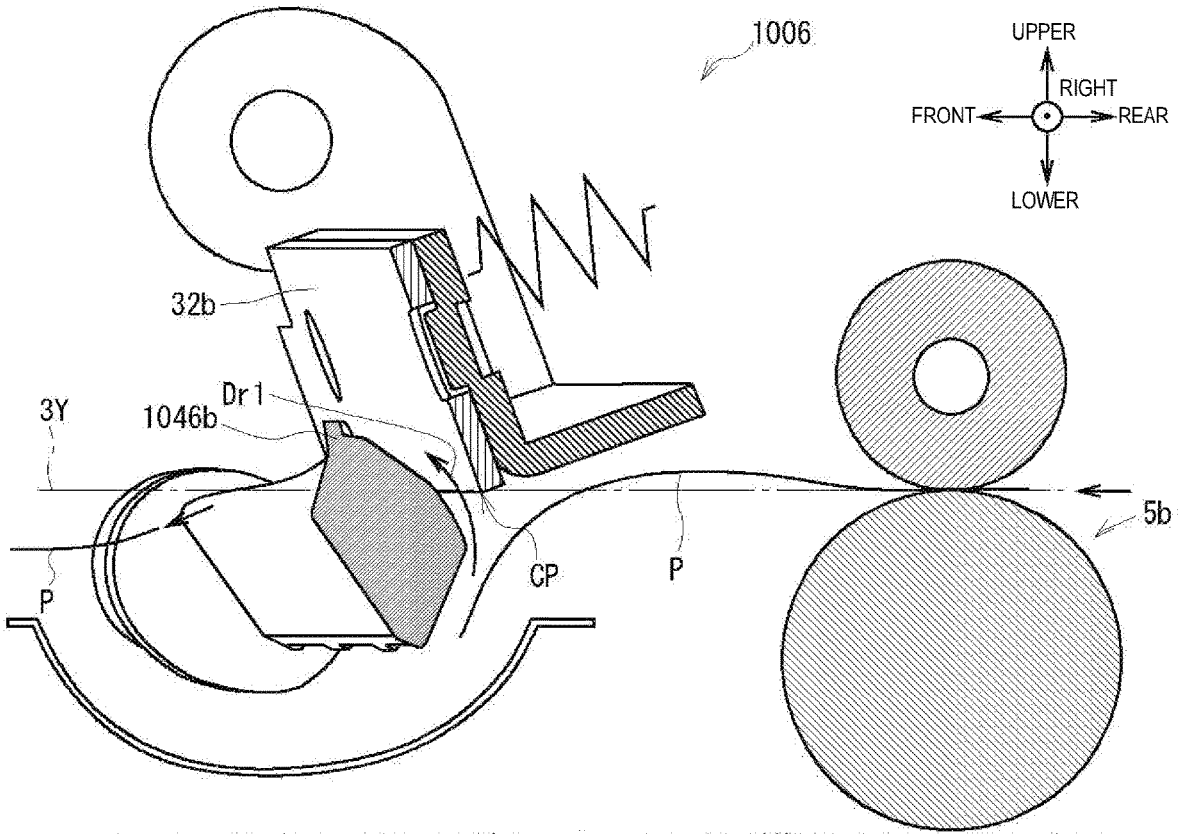
FIG. 18 is a diagram illustrating an enlarged cross-sectional view of the sheet cutting unit according to the related art, in a state (2) where the sheet is being conveyed in the sheet cutting unit.

FIGS. 17 and 18 illustrate views of a sheet cutting unit 1006 of a medium cutting device according to a related art. The sheet cutting unit 1006 includes a fixed blade 32*b* positioned above the conveyance path 3Y and a rotary blade 1046*b* positioned below the conveyance path 3Y. The rotary blade 1046*b* is rotated in the rotation direction Dr1, while the sheet P is conveyed by the conveyance roller pair 5*b*, to cut the sheet P. When the sheet cutting unit 1006 cuts the sheet P (particularly a thin sheet) while conveying the sheet P, a portion of the sheet P upstream than the cutting point CP may be bent upward such that the leading end thereof is oriented downward. When the bent of the sheet P is released at the end of cutting of the sheet P, the leading end of the sheet P moves downward below the lower side of the rotary blade 1046*b* as illustrated in FIG. 18, which may cause the jamming of the sheet P.

However, the sheet cutting unit 6 according to an embodiment is configured as described above. Thus, when the leading end Pse of the next sheet Ps is moved toward the rotary blade 46*b*, the sheet cutting unit 6 can catch the leading end Pse of the next sheet Ps by the recessed portion 62 and guide the next sheet leading end Pse toward the fixed blade 32*b* side.

2. Second Embodiment

[2-1. Configuration of Image Formation Apparatus]

An image formation apparatus 101 (see FIG. 1) according to a second embodiment is different from the image formation apparatus 1 according to a first embodiment in that the image formation apparatus has a sheet cutting unit 106, instead of the sheet cutting unit 6 (FIG. 2) of the image formation apparatus 1. However, the other configurations of the image formation apparatus 101 are configured in the same manner as or a similar manner to those of the image formation apparatus 1.

[2-2. Configuration of Sheet Cutting Unit]

Figure 15:
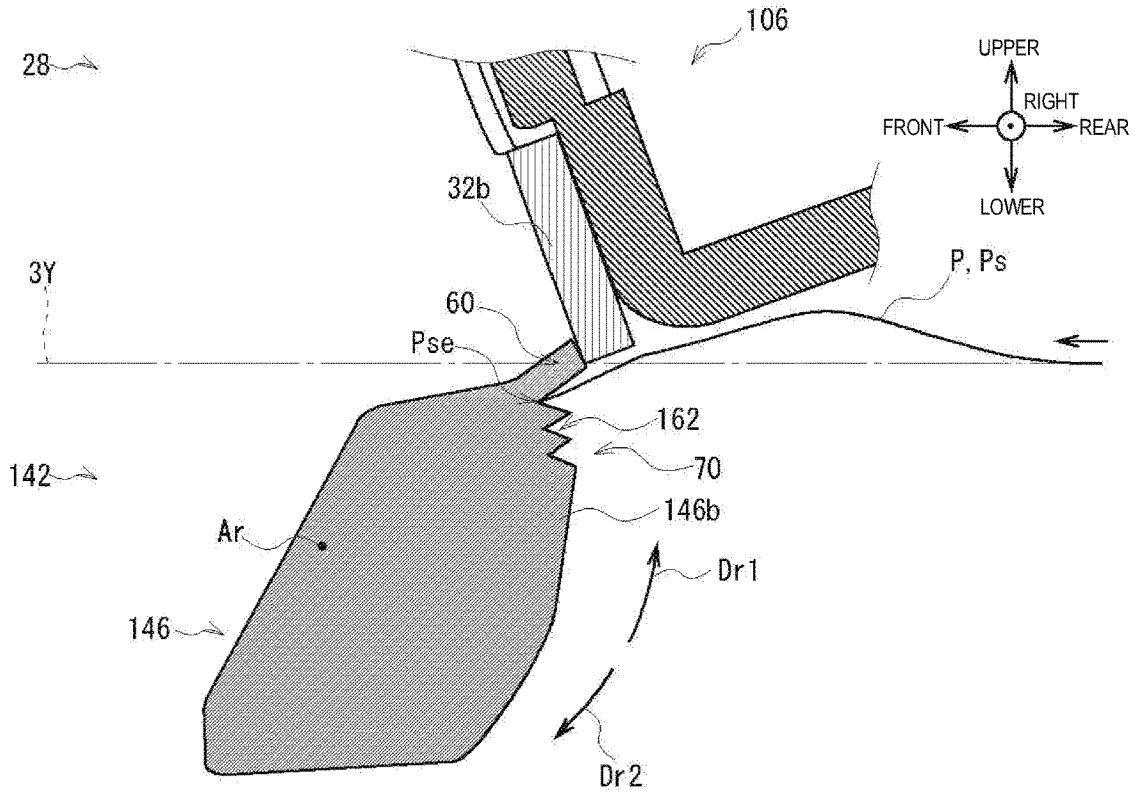
FIG. 15 is a diagram illustrating a cross-sectional view of a configuration of a rotary blade according to a second embodiment.

The sheet cutting unit 106 (FIG. 2) according to a second embodiment is different from the sheet cutting unit 6 (FIG. 7) according to a first embodiment in that the sheet cutting unit 106 includes a rotary blade unit 142 illustrated in FIG. 15, instead of the rotary blade unit 42 of the sheet cutting unit 6 illustrated in FIG. 7. However, the other configurations of the sheet cutting unit 106 are configured in the same manner as or a similar manner to those of the sheet cutting unit 6. In FIG. 15, the same configurations are designated as the same reference numerals as in FIG. 7.

[2-3. Configuration of Rotary Blade Unit]

The rotary blade unit 142 (FIG. 15) according to a second embodiment is different from the rotary blade unit 42 according to a first embodiment in that of the rotary blade unit 142 includes a rotary blade part 146 instead of the rotary blade part 46 of the rotary blade unit 42. The other configurations of the rotary blade unit 142 are configured in the same manner as or a similar manner to those of the rotary blade unit 42. Specifically, the rotary blade part 146 according to a second embodiment is different from the rotary blade part 46 according to a first embodiment in that the rotary blade part 146 includes a rotary blade 146*b* instead of the rotary blade 46*b* of the rotary blade part 46. The other configurations of the rotary blade 146*b* are configured in the same manner as or similar manner to those of the rotary blade 46*b*.

[2-3-1. Configuration of Rotary Blade]

Although the rotary blade 146*b* according to a second embodiment is different from the rotary blade 46*b* according to a first embodiment in that the rotary blade 146*b* has stepped portions 70 (FIG. 15) instead of the recessed portion 62 (FIG. 7), the other configurations of the rotary blade 146*b* are configured in the same manner as or a similar manner to those of the rotary blade 46*b*. The rotary blade 146*b* includes the stepped portions 70 on the reverse direction Dr2 side with respect to the root of the cutting edge 60. The stepped portions 70 has a plurality of (for example, three) recessed portions 162, each of which has substantially same shape as the recessed portion 62 and have a smaller size than the recessed portion 62, are arranged along the circumferential direction about the rotation axis Ar. The cross sectional shape of the stepped portions 70 continues in the same shape along the entire width from the end of the rotary blade 146*b* on the cutting start position Pcs side to the end of the rotary blade 146*b* on the cutting end position Pce side.

As described above, the sheet cutting unit 106 is provided with the stepped portions 70 provided on the reverse direction Dr2 side with respect to the root of the cutting edge 60 of the rotary blade 146*b*, wherein the stepped portions 70 include a plurality of recessed portions arranged along the circumferential direction centering on the rotation axis Ar. With this configuration, after cutting the sheet P, the sheet cutting unit 106 catches the leading end Pse of the next sheet Ps that tends to move downward, by means of any one of the recessed portions 162 of the stepped portions 70 and lifts the next sheet leading end Pse upward to guide the next sheet leading end Pse toward the fixed blade 32*b* side. As a result, the sheet cutting unit 106 can prevent the leading end Pse of the next sheet Ps from moving toward the lower side of the rotary blade 146*b*, so as to prevent the jamming.

Further, the sheet cutting unit 106 according to a second embodiment is formed with the plurality of the recessed portions 162 along the circumferential direction centering on the rotation axis Ar. Thus, even if the leading end Pse of the next sheet Ps is not caught by the first one of the recessed portions 162 closest to the cutting edge 60 on the reverse direction Dr2 side, the leading end Pse of the next sheet Ps may be caught in the second recessed portion 162 or the third recessed portion 162.

The rotary blade 146*b* according to a second embodiment may be made of metal, and is manufactured by casting, for example. in such a manufacturing process, a concavo-convex shape may be formed on the outer peripheral surface of the rotary blade 146*b*. Thus, the concavo-convex shape on the rotary blade 146*b* formed in the manufacturing process may be used as the stepped portions 70 as they are, so that it is not necessary to separately execute (add) a process to form the stepped portions 70 on the rotary blade 146*b*.

Note that in other aspects, the image formation apparatus 101 according to a second embodiment can also achieve operational effects same as or similar to the image formation apparatus 1 according to a first embodiment.

3. Third Embodiment

[3-1. Configuration of Image Formation Apparatus]

The image formation apparatus 201 (FIG. 1) according to a third embodiment is different from the image formation apparatus 1 according to a first embodiment, in that the image formation apparatus 201 includes a sheet cutting unit 206 instead of the sheet cutting unit 6 (FIG. 2) according to a first embodiment. The other configurations other than the sheet cutting unit 206 are configured in the same manner as or similar manner to those of the sheet cutting unit 6.

[3-2. Configuration of Sheet Cutting Unit]

Figure 16:
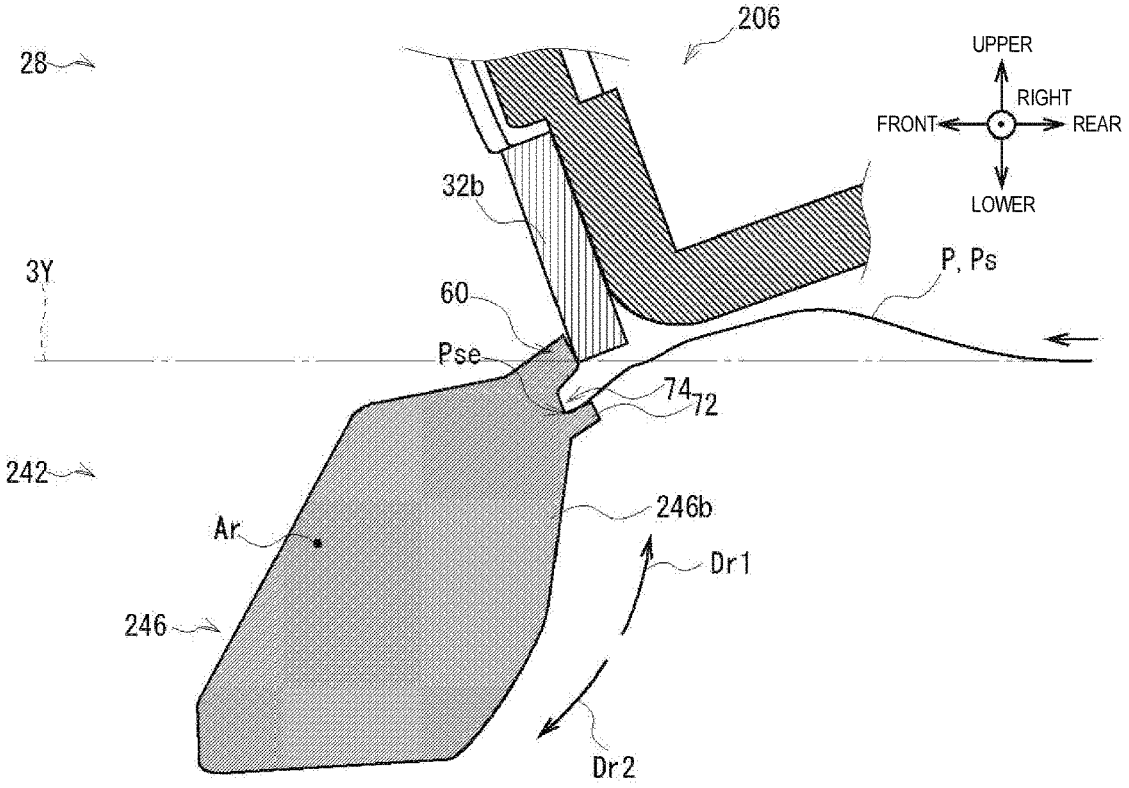
FIG. 16 is a diagram illustrating a cross-sectional view of a configuration of a rotary blade according to a third embodiment.

The sheet cutting unit 206 (FIG. 2) according to a third embodiment is different from the sheet cutting unit 6 according to a first embodiment in that the sheet cutting unit 206 includes a rotary blade unit 242 illustrated in FIG. 16 instead of the rotary blade unit 42 illustrated in FIG. 7. The other configurations other than the rotary blade unit 242 are configured in the same manner as or similar manner to those of the rotary blade unit 42. In FIG. 16, the same or similar configurations are designated as the same reference numerals as in FIG. 7.

[3-3. Configuration of Rotary Blade Unit]

The rotary blade unit 242 (FIG. 16) according to a third embodiment is different from the rotary blade unit 42 according to a first embodiment in that the rotary blade unit 242 (FIG. 16) includes a rotary blade part 246 instead of the rotary blade part 46 and the other configurations of the rotary blade unit 242 are configured in the same manner as or a similar manner to those of the rotary blade unit 42. Specifically, the rotary blade part 246 according to a third embodiment is different from the rotary blade part 46 according to a first embodiment in that the rotary blade part 246 includes a rotary blade 246*b* instead of the rotary blade 46*b* of the rotary blade part 46. The other configurations of the rotary blade part 246 are configured in the same manner as or a similar manner to those of the rotary blade part 46.

[3-3-1. Configuration of Rotary Blade]

The rotary blade 246*b* according to a third embodiment is different from the rotary blade 46*b* according to a first embodiment in that the rotary blade 246*b* includes a single protrusion 72 (FIG. 16) instead of the recessed portion 62 (FIG. 7) of the rotary blade 46*b*, and the other configurations of the rotary blade 246*b* are configured in the same manner as or a similar manner to those of the rotary blade 46*b*. The rotary blade 246*b* is formed with the protrusion 72 that is provided on the reverse direction Dr2 side with respect to the root of the cutting edge 60 and protrudes outwardly in a direction away from the rotation axis Ar. The protrusion 72 has the same cross section continuous along the conveying width direction, which is parallel with the cutting edge 60, from the end of the rotary blade 246*b* on the cutting start position Pcs side to the end of the rotary blade 246*b* on the cutting end position Pce side. That is, the rotary blade 246*b* includes a groove 74 formed between the cutting edge 60 and the protrusion 72 as a recessed portion recessed toward the rotation axis Ar side from the tip of the cutting edge 60 and the tip of the protrusion 72.

As described above, the sheet cutting unit 206 according to a third embodiment is provided with the protrusion 72 projecting outwardly away from the rotation axis Ar and provided on the reverse direction Dr2 side from the root of the cutting edge 60 of the rotary blade 246*b*, such that the groove 74 is formed between the protrusion 72 and the protrusion 72. With this configuration, after cutting the sheet P, the groove 74 of the sheet cutting unit 206 can catch the leading end Pse of the next sheet Ps that tends to go downward and lift up the leading end Pse of the next sheet Ps toward the fixed blade 32*b* side. As a result, the sheet cutting unit 206 can prevent the leading end Pse of the next sheet Ps from moving toward the lower side of the rotary blade 246*b*, so as to prevent the jamming.

Note that in the other aspects, the image formation apparatus 201 according to a third embodiment can also achieve operational effects same as or similar to the image formation apparatus 1 according to a first embodiment.

4. Other Embodiments

In the first embodiment described above, the recessed portion 62 is continuously formed along the conveyance width direction from the one end of the rotary blade 46*b* on the cutting start position Pcs side to the other end of the rotary blade 46*b* on the cutting end position Pce side. The invention is not limited to this. For example, the recessed portion 62 may be formed in only about half of the entire length on the cutting start position Pcs side in the conveyance width direction. The same may apply to second and third embodiments.

Here, the next sheet after cutting tends to start sagging from the cutting start position Pcs side to the rotary blade 46*b* side, not from the cutting end position Pce side to the rotary blade 46*b* side. Therefore, even in the case where the recessed portion 62 is not provided at a portion of the rotary blade on the cutting end position Pce side, the sheet cutting unit 6 can guide the end of the next sheet Ps on the cutting start position Pcs side which tends to start sagging toward the rotary blade 46*b*, toward the fixed blade 32*b* side.

In a case where a plurality of types of sheets is used in the image formation apparatus 1, the plurality of types of sheets may have different widths in the conveyance width direction. In such a case, if the sheets are conveyed in such a manner that the central portion of the sheets in the conveyance width direction are aligned with the central portion or the right end portion in the conveyance width direction in the conveyance path 3Y, the positions in the conveyance width direction that starts to be cut at the cutting point CP are different from each other among the sheets having different widths.

In view of this, it may be preferable that the sheet cutting unit 6 includes the recessed portion 62 extending at least to positions corresponding to the cutting start position Pcs side ends of all types of the sheets having different widths in the conveyance width direction, which are handled in the image formation apparatus 1. As a result, the sheet cutting unit 6 can prevent the leading ends Pse of various type of the sheets having different widths from dripping from the conveyance path 3Y toward the lower side of the rotary blade 46*b*. Further, if the sheet handled in the image formation apparatus 1 is a single size sheet, the length in the conveyance width direction may be shortened so as to include only the cutting start position Pcs side end of the sheet. The same may apply to second and third embodiments.

Further, in a first embodiment described above, the recessed portion 62 is continuously provided along the conveyance width direction. The invention is not limited to this. For example, the recessed portion 62 may include plural recessed portions intermittently provided along the conveyance width direction. The same may apply to second and third embodiments.

Further, in a first embodiment described above, the cross sectional shape of the recessed portion 62 extends in the same in the entire length along the conveyance width direction from the cutting start position Pcs side end to the cutting end position Pce side end of the rotary blade 46*b*. The invention is not limited to this. For example, the shape of the cross section of the recessed portion 62 may not be the same in the entire length along the conveyance width direction. The same may apply to second and third embodiments.

In a first embodiment described above, the bottom corner angle A1 is set to 90 degree or less. However, the invention is not limited to this. In a case where the bottom corner angle A1 is larger than 90 degree, it is preferable that when the leading end Pse of the next sheet Ps comes in contact with the inner rear surface 62*b*, an angle between the leading end Pse of the next sheet Ps and a part of the inner rear surface 62*b* on the reverse direction Dr2 side is 90 degree or less. In such a case, when the leading end Pse of the next sheet Ps contacts the inner rear surface 62*b* of the recessed portion 62, the leading end Pse of the next sheet Ps is moved toward the bottom corner portion 62*c* so as to be bitten into the bottom corner portion 62*c*, and thus does not come out of the recessed portion 62 easily.

Furthermore, in a first embodiment described above, the rear angulated portion 62*d* may be rounded or chamfered. In such a case, the leading end Pse of the next sheet Ps can easily be removed out of the recessed portion 62 after being lifted up.

Further, in a second embodiment described above, the stepped portions 70 includes the three recessed portions 162. However, the invention is not limited to this. For example, the stepped portions 70 includes an arbitrary number of the recessed portions 162.

Further, in a third embodiment described above, the one protrusion 72 and the one groove 74 are provided. However, the invention is not limited to this. For example, an arbitrary number of grooves 74 may be provided by an arbitrary number of protrusions 72.

Furthermore, in a first embodiment described above, the fixed blade unit 28 and the rotary blade unit 42 are respectively arranged on the upper side and the lower side of the conveyance path 3Y in the sheet cutting unit 6. However, the invention is not limited to this. For example, a sheet cutting unit may include a rotary blade unit and a fixed blade unit provided on the upper side and the lower side of the conveyance path 3Y, respectively, or a sheet cutting unit may include a rotary blade unit and a fixed blade unit provide respectively on the upstream side and the downstream side of the conveyance path extending along the vertical direction. The same may apply to second and third embodiments.

Further, in first to third embodiments described above, the sheet cutting unit 6, 106 or 206 that cuts the sheet that is unwind form the rolled sheet. However, the invention is not limited to this, and may be applied to a sheet cutting unit that cuts a cut sheet or the like.

Further, in first to third embodiments described above, the sheet cutting unit 6, 106, or 206 is provided upstream of the image formation section 8 in the conveyance direction. However, the invention is not limited to this. For example, the sheet cutting unit 6, 106, or 206 may be provided downstream of the image formation section 8 in the conveyance direction.

Further, in first to third embodiments described above, the direct transfer type image formation apparatus 1, 101 or 201 has been described. However, the invention is not limited to this, and may be applied to various types of image formation apparatuses or the like such as an intermediate transfer type image formation apparatus in which a toner image primarily transferred onto an intermediate transfer belt is secondarily transferred onto a sheet serving as a medium.

Further, in first to third embodiments described above, the image formation apparatus 1, 101, or 201 uses the three process units 9. However, the invention is not limited to this, and may be applied to a single-color image formation apparatus using one process unit, or an image formation apparatus using any number of process units of two or four or more.

Further, in first to third embodiments described above, the sheet cutting unit 6, 106 or 206 provided in the image formation apparatus 1, 101 or 201 which is an electrophotographic printer. However, the invention is not limited to this, and may also be applied to a sheet cutting unit provided in an image formation apparatus included in an MFP (Multi Function Printer), a copying machine, an automatic document reading device, or the like.

Furthermore, the invention is not limited to first to third embodiments and other embodiments described above. That is, the scope of the invention extends to embodiments in which some or all of the above-described first to third embodiments and other embodiments are arbitrarily combined, and embodiments in which some are extracted.

Furthermore, in a first embodiment described above, the sheet cutting unit 6 as the medium cutting device is configured to include the fixed blade in the fixed blade unit 28 and the rotary blade in the rotary blade unit 42. However, the invention is not limited to this. For example, a medium cutting device may be configured to include fixed and rotary blades having various configurations.

The invention can also be used in various devices for cutting sheet.

The invention includes other embodiments in addition to the above-described embodiments and modifications without departing from the spirit of the invention. The embodiments and modifications are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. A medium cutting device comprising:

a fixed blade provided on one side with respect to a conveyance path in which a medium is conveyed in a thickness direction of the medium orthogonal to a surface of the medium and including a cutting edge thereof; and a rotary blade provided on the other side with respect to the conveyance path in the thickness direction, and including a cutting edge thereof, wherein the rotary blade is rotatable and configured to be rotated in a rotation direction so that the cutting edge of the rotary blade passes through the cutting edge of the fixed blade to cut the medium being conveyed, wherein the rotary blade includes, on an outer circumferential surface, a recessed portion provided on a side of the cutting edge of the rotary blade in a reverse direction opposite to the rotation direction of the rotary blade, the recessed portion includes a bottom corner portion on a side closer to a rotation axis of the rotary blade in a radial direction about the rotation axis and opened to an outer side in the radial direction, and a first distance from an apex of the bottom corner portion of the recessed portion to a tip of the cutting edge of the rotary blade is shorter than a second distance, wherein the second distance is a distance by which the medium should have traveled downstream in a conveyance direction of the medium during a sheet cutting process if the medium that is blocked between the cutting edge of the rotary blade and the cutting edge of the fixed blade is not blocked.

2. The medium cutting device according to claim 1, wherein the recessed portion of the rotary blade is provided at a position adjacent to the cutting edge of the rotary blade on the side of the cutting edge of the rotary blade in the reverse direction.

3. The medium cutting device according to claim 1, wherein the second distance is obtained by multiplying a conveyance speed St of the medium by a blade contact time, which is a length of time during which the fixed blade and the rotary blade are in contact with each other when cutting the medium.

4. The medium cutting device according to claim 3, wherein the blade contact time is obtained by dividing a thickness of the cutting edge by a value obtained by multiplying a distance, from the rotation axis to the tip of the cutting edge of the rotary blade, by a rotational speed Rs of the rotary blade.

5. The medium cutting device according to claim 1, wherein the recessed portion includes an angulated portion at an end of the recessed portion in the reverse direction, wherein the angulated portion of the recessed portion is not protruded to an outer side of a rotational trajectory of the cutting edge of the rotary blade about the rotation axis of the rotary blade.

6. The medium cutting device according to claim 5, wherein a distance from the rotation axis to the tip of the cutting edge of the rotary blade is larger than a distance from the rotation axis to the angulated portion.

7. The medium cutting device according to claim 1, wherein the recessed portion includes the bottom corner portion on the side closer to the rotation axis of the rotary blade in the radial direction about the rotation axis and opened to the outer side in the radial direction, wherein an inner angle of the bottom corner portion is not more than 90 degree.

8. The medium cutting device according to claim 1, wherein the recessed portion continues to extend in a same shape from one end to the other end of the recessed portion in a width direction which is orthogonal to the thickness direction and the conveyance direction of the medium.

9. The medium cutting device according to claim 1, wherein the recessed portion is provided at at least a portion of an entire length of the rotary blade, on a side of a cutting start position where the medium starts to be cut, in a width direction which is orthogonal to the thickness direction and the conveyance direction of the medium.

10. The medium cutting device according to claim 9, wherein the recessed portion extends at least to all of positions corresponding to ends of a plurality types of media having different widths on the cutting start position side in the width direction, wherein each of the media can be conveyed in the medium cutting device.

11. The medium cutting device according to claim 9, wherein the recessed portion continuously extends along the width direction.

12. The medium cutting device according to claim 1, wherein the recessed portion comprises a plurality of recessed portions arranged in the rotation direction.

13. The medium cutting device according to claim 1, wherein the rotary blade includes, on the outer circumferential surface, a protrusion provided on the reverse direction side of the cutting edge of the rotary blade and protruding outwardly in the radial direction about the rotation axis of the rotary blade, such that the recessed portion is provided between the protrusion and the cutting edge of the rotary blade.

14. The medium cutting device according to claim 1, wherein the recessed portion includes: the bottom corner portion on the side closer to the rotation axis of the rotary blade in the radial direction about the rotation axis; and an angulated portion at an end of the recessed portion in the reverse direction, wherein the angulated portion of the recessed portion is provided outside, in the radial direction, of a rotational trajectory of the bottom corner portion about the rotation axis.

15. An image formation apparatus comprising the medium cutting device according to claim 1.

16. An image formation apparatus comprising:

the medium cutting device according to claim 1 configured to cut the medium and feed the cut medium along the conveyance path; and an image formation unit provided downstream of the medium cutting device in the conveyance path and configured to form an image on the cut medium fed from the medium cutting device along the conveyance path.

* * * * *